US012092375B2

(12) United States Patent
Wong

(10) Patent No.: US 12,092,375 B2
(45) Date of Patent: Sep. 17, 2024

(54) CENTRAL AIR CONDITIONING AND HEAT PUMP SYSTEM WITH COOLING ARRANGEMENT

(71) Applicant: Lee Wa Wong, Alhambra, CA (US)

(72) Inventor: Lee Wa Wong, Alhambra, CA (US)

( * ) Notice: Subject to any disclaimer, the term of this patent is extended or adjusted under 35 U.S.C. 154(b) by 0 days.

(21) Appl. No.: 18/264,144

(22) PCT Filed: Feb. 4, 2021

(86) PCT No.: PCT/US2021/016677
§ 371 (c)(1),
(2) Date: Aug. 3, 2023

(87) PCT Pub. No.: WO2022/169452
PCT Pub. Date: Aug. 11, 2022

(65) Prior Publication Data
US 2024/0044553 A1 Feb. 8, 2024

(51) Int. Cl.

| | |
|---|---|
| ***F25B 13/00*** | (2006.01) |
| ***F24F 3/00*** | (2006.01) |
| ***F24F 3/06*** | (2006.01) |
| ***F25B 41/20*** | (2021.01) |

(52) U.S. Cl.
CPC ..... *F25B 13/00* (2013.01); *F24F 3/001* (2013.01); *F24F 3/06* (2013.01); *F25B 41/20* (2021.01); *F25B 2313/003* (2013.01)

(58) Field of Classification Search
CPC ... F24F 3/001; F24F 3/06; F25B 13/00; F25B 41/20; F25B 2313/003
See application file for complete search history.

(56) References Cited

U.S. PATENT DOCUMENTS

| | | | | |
|---|---|---|---|---|
| 3,938,352 | A | 2/1976 | Schmidt | |
| 4,285,392 | A * | 8/1981 | Rannow | F25B 29/003 165/95 |
| 4,457,358 | A * | 7/1984 | Kriege | F24F 3/06 62/305 |
| 6,041,613 | A | 3/2000 | Morse et al. | |
| 2016/0091215 | A1 | 3/2016 | Wong | |
| 2018/0128506 | A1 | 5/2018 | Taras et al. | |

* cited by examiner

*Primary Examiner* — Larry L Furdge
(74) *Attorney, Agent, or Firm* — Tsz Lung Yeung

(57) ABSTRACT

A central air conditioning and heat pump system includes a main heat exchange system and a cooling arrangement. The main heat exchange system includes a compressor, a first heat exchanger, a second heat exchanger. The cooling arrangement includes a cooling tower and a condensing unit. When the central air conditioning and heat pump system is selectively operated in an air conditioning mode, refrigerant is cooled both by water and ambient air in the condensing unit and the second heat exchanger respectively.

29 Claims, 7 Drawing Sheets

CENTRAL AIR CONDITIONING AND HEAT PUMP SYSTEM WITH COOLING ARRANGEMENT

BACKGROUND OF THE PRESENT INVENTION

Field of Invention

The present invention relates to a central air conditioning and heat pump system which is capable of saving a substantial amount of energy when the central air conditioning and heat pump system is being operated in a heat pump mode.

Description of Related Arts

Conventional air conditioning and heat pump systems may be broadly divided into two main types. The first type is air conditioning and heat pump systems which are arranged to directly heat up or cool down the air of an indoor space. An example of the first type is window-type air conditioning and/or heat pump units, which controllably suck air from the indoor space and directly heat up or cool down the air. After the air has been heated or cooled, it is delivered back to the indoor space.

The second type is central air conditioning heat pump systems in which a heat exchange medium (usually water) may be used to heat up or cool down the air in the indoor space. Referring to FIG. 1 to FIG. 5 of the drawings, the central air conditioning and heat pump system comprises a main heat exchange system 10P and a heat delivery system. The main heat exchange system 10P comprises an outer casing 11P, a compressor 12P, at least one heat exchanger 13P, a gas-liquid heat exchanging device 14P, and a fan assembly 15P. The main heat exchange system 10P is usually installed on a roof of a building so that it may absorb heat from or discharge heat to ambient air. A predetermined amount of refrigerant may circulate through the compressor 12P, the heat exchanger 13P, the gas-liquid heat exchanging device 14P and other components for carrying out several heat exchanging processes.

On the other hand, the heat delivery system comprises a water pump 21P and a water pipeline system 22P connected to the water pump 21P. The water pipeline system 22P is configured to transport water to different designated indoor spaces in the building. The water circulating in the heat delivery system is arranged to perform heat exchange with the refrigerant in the gas-liquid heat exchanging device 14P of the main heat exchange system 10P. Furthermore, the heat delivery system may further comprise a fresh air supplying device 23P connected to the water pipeline system 22P. As shown in FIG. 5 of the drawings, the fresh air supplying device 23P usually comprises a supporting frame 231P, a centrifugal fan 232P received in the supporting frame 231P, and a fresh air heat exchanger 233P also received in the supporting frame 231P. The supporting frame 231P has an air inlet 2311P, wherein ambient air may be drawn into the fresh air supplying device 23P through the air inlet 2311P.

The refrigerant circulating in the main heat exchange system 10 is arranged to absorb heat from ambient air and release heat to the water circulating through the gas-liquid heat exchanging device 14P. The water having absorbed heat from the refrigerant is then pumped to various terminal devices such as the fresh air supplying device 23P. The purpose of the terminal devices is to regulate and ventilate air to and from a designated indoor space. Within a heat delivery system, there may exist a number of terminal devices which may include the above-mentioned fresh air supplying device 23P, or other air handlers.

The water delivered to the fresh air supplying device 23P is arranged to carry out heat exchange with the ambient air in the fresh air heat exchanger 233P. The water is arranged to release heat to the air. The heated air may be transported to the designated indoor space for supplying fresh air to the indoor environment. The heating of the ambient air is essential because the temperature of the ambient air is usually very low and that is the very reason why the central air conditioning heat pump system is used to generate heat in the indoor space.

Although the above-mentioned air conditioning and heat pump systems have widely been utilized around the world for many years, these systems suffer a common deficiency of a relatively low Coefficient of Performance (COP), which may be defined as a ratio of heat supplied to or removed from a reservoir to the work required.

Accordingly, there is a need to develop an air conditioning and heat pump system which has substantially improved COP.

SUMMARY OF THE PRESENT INVENTION

Certain variations of the present invention provide an air conditioning and heat pump system which is capable of saving a substantial amount of energy when the air conditioning and heat pump system is being operated.

Certain variations of the present invention provide an air conditioning and heat pump system which may selectively utilize cooling water in a cooling tower to cool down the temperature of the refrigerant when the air conditioning and heat pump system is being operated in a comprehensive air conditioning mode.

Certain variations of the present invention provide an air conditioning and heat pump system which may allow refrigerant from being cooled by heat exchangers or a cooling tower.

Certain variations of the present invention provide an air conditioning and heat pump system which is capable of producing more heat to designated indoor space for a given work done by the system as compared with conventional air conditioning and heat pump system as described above.

In one aspect of the present invention, the present invention provides a central air conditioning and heat pump system for a heat distribution system, comprising:

- a plurality of connecting pipes;
- a main heat exchange system, which comprises: a compressor having a compressor outlet and a compressor inlet; a first heat exchanger connected to the compressor through at least one of the connecting pipes; and a second heat exchanger connected to the compressor and the first heat exchanger through at least one of the connecting pipes; and
- a cooling arrangement, which comprises: a condensing unit; a cooling tower, which comprises: a tower casing having a cooling tower air inlet, a cooling tower air outlet, a cooling tower water inlet and a cooling tower water outlet; at least one cooling unit which comprises a first water collection basin connected to the cooling tower water inlet, and a first fill material unit provided under the first water collection basin; a water storage tank provided under the first fill material; a fan provided in the tower casing for drawing ambient air to flow from the cooling tower air inlet to the cooling tower air outlet; a condensing unit; and a pump connected between the cooling tower and the condensing unit for pumping water to circulate between the cooling tower and the condensing unit, the condensing unit connecting to the cooling tower, the first heat exchanger and the second heat exchanger through at least one of the connecting pipes, and being arranged to perform heat exchange between the water flowing out of the cooling tower and refrigerant flowing out from the second heat exchanger; and the air conditioning and heat pump system being selectively operated between a comprehensive air conditioning mode and a heat pump mode, wherein in the comprehensive air conditioning mode, a predetermined amount of vaporous refrigerant is arranged to leave the compressor and guided to enter the second heat exchanger for releasing heat thereto, the refrigerant leaving the second heat exchanger being guided to flow into the condensing unit for releasing a predetermined amount of heat to the water circulating between the condensing unit and the cooling tower, the refrigerant leaving the condensing unit being guided to flow through the first heat exchanger for absorbing heat from the heat distribution system, the refrigerant leaving the first heat exchanger being guided to flow back to the compressor to complete an air conditioning cycle, wherein in the heat pump mode, a predetermined amount of vaporous refrigerant is arranged to leave the compressor and guided to flow into the first heat exchanger for releasing heat to the heat distribution system, the refrigerant leaving the first heat exchanger being guided to flow into the condensing unit for being temporarily stored, the refrigerant leaving the condensing unit being guided to flow to the second heat exchanger for absorbing heat from ambient air, the refrigerant leaving the second heat exchanger being guided to flow back to the compressor to complete a heat pump cycle.

In another aspect of the present invention, the present invention provides a central air conditioning and heat pump system for a heat distribution system, comprising:

a plurality of connecting pipes;

a main heat exchange system, which comprises: a compressor having a compressor outlet and a compressor inlet; a first heat exchanger connected to the compressor through at least one of the connecting pipes; and a second heat exchanger connected to the compressor and the first heat exchanger through at least one of the connecting pipes; and a cooling arrangement, which comprises:

a condensing unit;

a cooling tower, which comprises: a tower casing having a cooling tower air inlet, a cooling tower air outlet, a cooling tower water inlet and a cooling tower water outlet; at least one cooling unit which comprises a first water collection basin connected to the cooling tower water inlet, and a first fill material unit provided under the first water collection basin; a water storage tank provided under the first fill material; a fan provided in the tower casing for drawing ambient air to flow from the cooling tower air inlet to the cooling tower air outlet; and a pump connected between the cooling tower and the condensing unit for pumping water to circulate between the cooling tower and the condensing unit, the condensing unit connecting to the cooling tower, the first heat exchanger and the second heat exchanger through at least one of the connecting pipes, and being arranged to perform heat exchange between the water flowing out of the cooling tower and refrigerant flowing out from the second heat exchanger; and the air conditioning and heat pump system being selectively operated between a comprehensive air conditioning mode, a water-cooled air conditioning mode, an air-cooled air conditioning mode, and a heat pump mode, wherein in the comprehensive air conditioning mode, a predetermined amount of vaporous refrigerant is arranged to leave the compressor and guided to enter the second heat exchanger for releasing heat thereto, the refrigerant leaving the second heat exchanger being guided to flow into the condensing unit for releasing a predetermined amount of heat to the water circulating between the condensing unit and the cooling tower, the refrigerant leaving the condensing unit being guided to flow through the first heat exchanger for absorbing heat from the heat distribution system, the refrigerant leaving the first heat exchanger being guided to flow back to the compressor to complete an air conditioning cycle, wherein in the water-cooled air conditioning mode, a predetermined amount of vaporous refrigerant is arranged to leave the compressor and guided to enter the condensing unit for releasing a predetermined amount of heat to the water circulating between the condensing unit and the cooling tower, the refrigerant leaving the condensing unit being guided to flow through the first heat exchanger for absorbing heat from the heat distribution system, the refrigerant leaving the first heat exchanger being guided to flow back to the compressor to complete an air conditioning cycle, wherein in the air-cooled air conditioning mode, a predetermined amount of vaporous refrigerant is arranged to leave the compressor and guided to enter the second heat exchanger for releasing heat thereto, the refrigerant leaving the second heat exchanger being guided to flow through the first heat exchanger for absorbing heat from the heat distribution system, the refrigerant leaving the first heat exchanger being guided to flow back to the compressor to complete an air conditioning cycle, wherein in the heat pump mode, a predetermined amount of vaporous refrigerant is arranged to leave the compressor and guided to flow into the first heat exchanger for releasing heat to the heat distribution system, the refrigerant leaving the first heat exchanger being guided to flow into the condensing unit for being temporarily stored, the refrigerant leaving the condensing unit being guided to flow to the second heat exchanger for absorbing heat from ambient air, the refrigerant leaving the second heat exchanger being guided to flow back to the compressor to complete a heat pump cycle.

DETAILED DESCRIPTION OF THE PREFERRED EMBODIMENT

The following detailed description of the preferred embodiment is the preferred mode of carrying out the invention. The description is not to be taken in any limiting sense. It is presented for the purpose of illustrating the general principles of the present invention.

Figure 1:
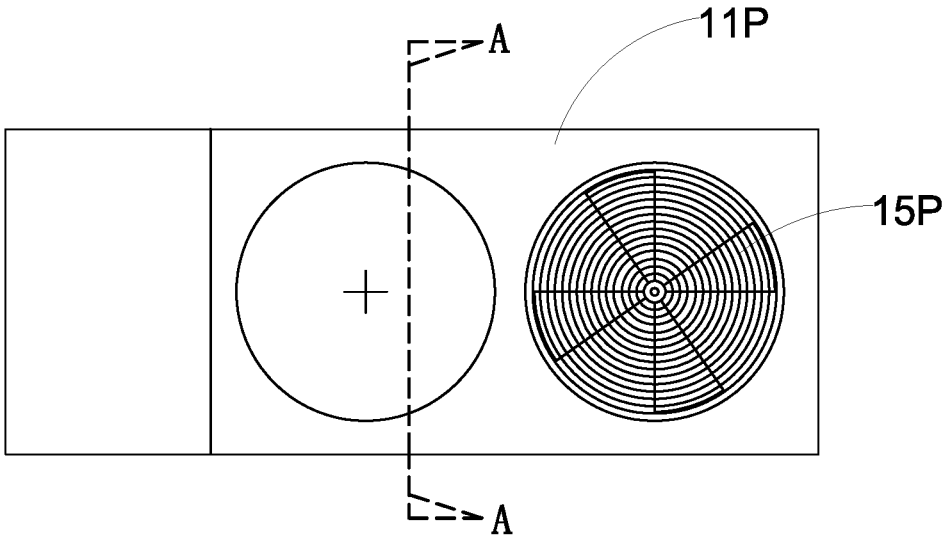
FIG 1 PRIOR ART
FIG. 1 is a top view of a main casing of a conventional central air conditioning and heat pump system.
Figure 2:
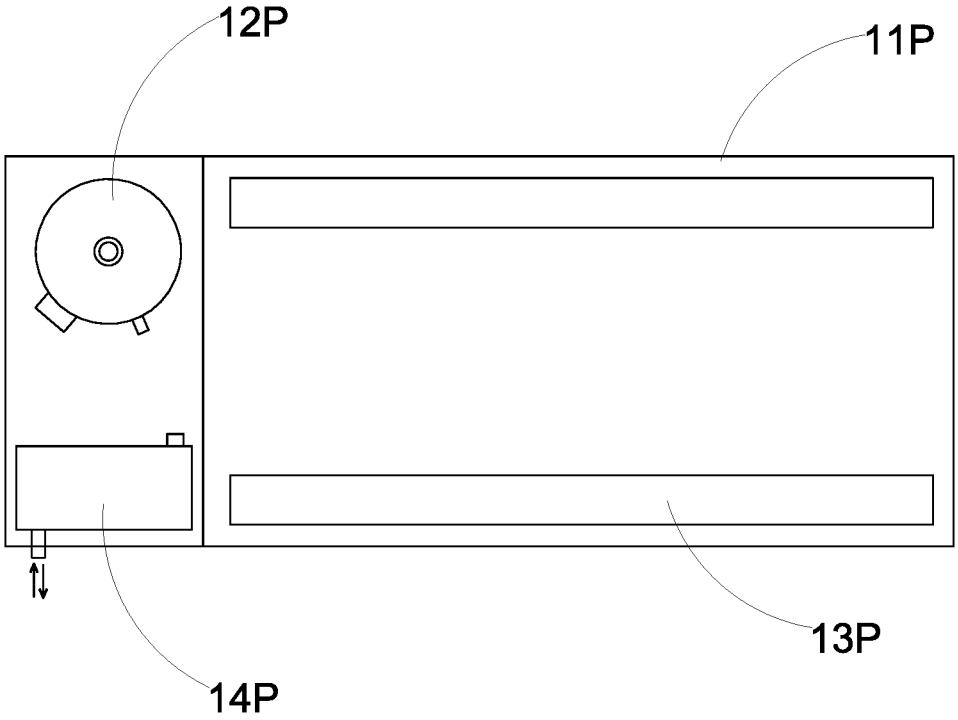
FIG 2 PRIOR ART
FIG. 2 is sectional top view of the main casing of the conventional central air conditioning and heat pump system.
Figure 3:
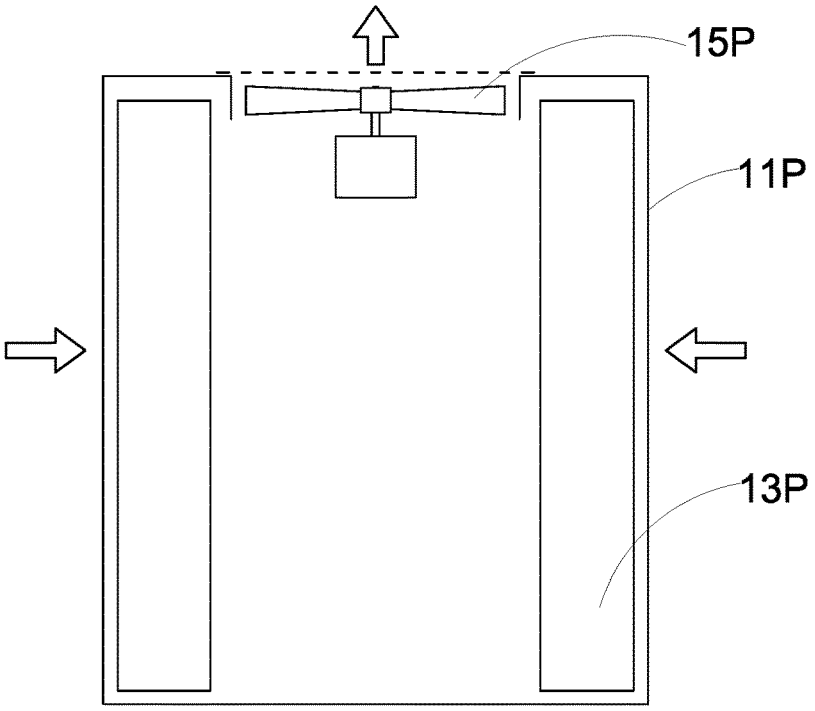
FIG 3 PRIOR ART
FIG. 3 is sectional side view of the main casing of the conventional central air conditioning and heat pump system along plane A-A of FIG. 1.
Figure 4:
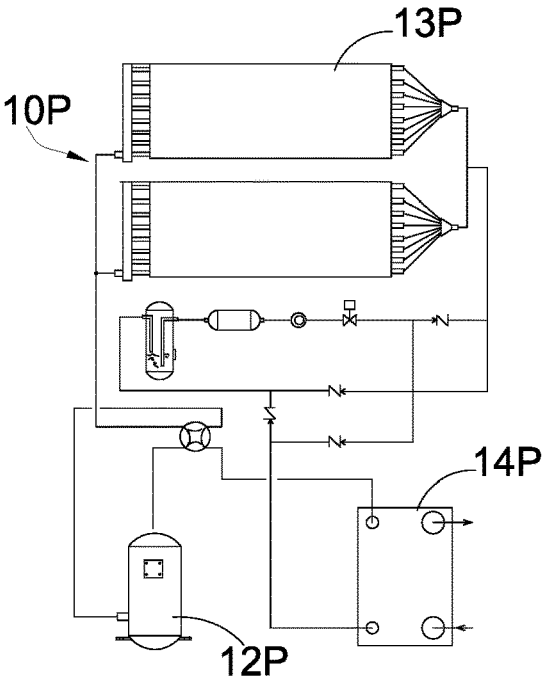
FIG 4 PRIOR ART
FIG. 4 is schematic diagram of a main heat exchange system of a conventional central air conditioning and heat pump system.
Figure 5:
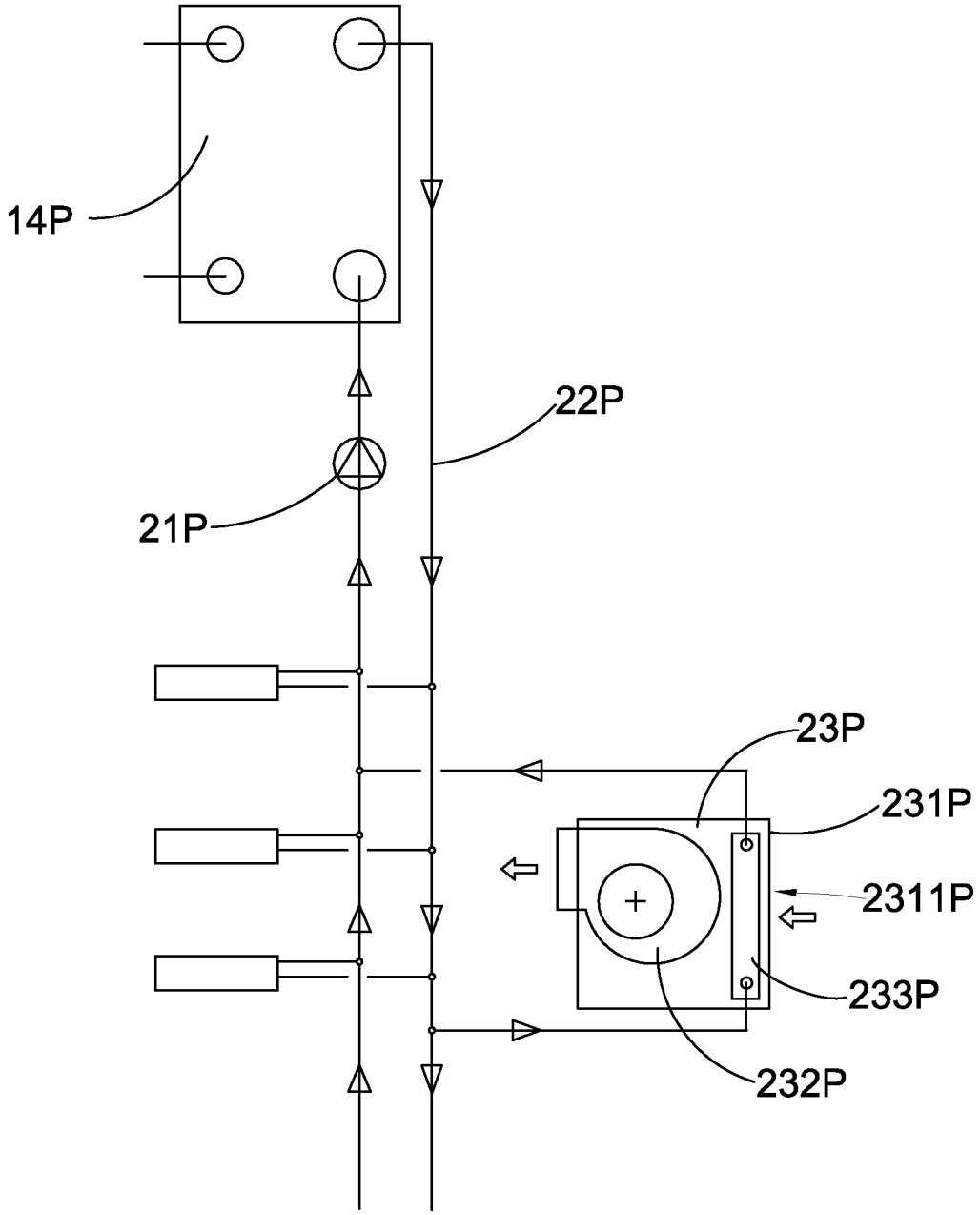
FIG 5 PRIOR ART
FIG. 5 is schematic diagram of a heat delivery system of a conventional central air conditioning and heat pump system.
Figure 6:
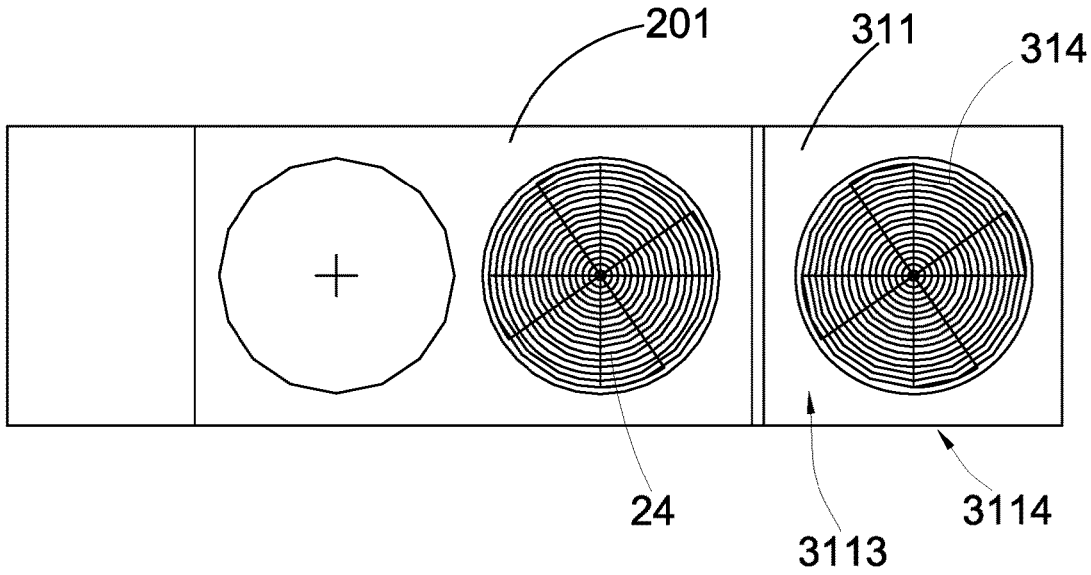
FIG. 6 is a top view of a central air conditioning and heat pump system according to a first preferred embodiment of the present invention.
Figure 7:
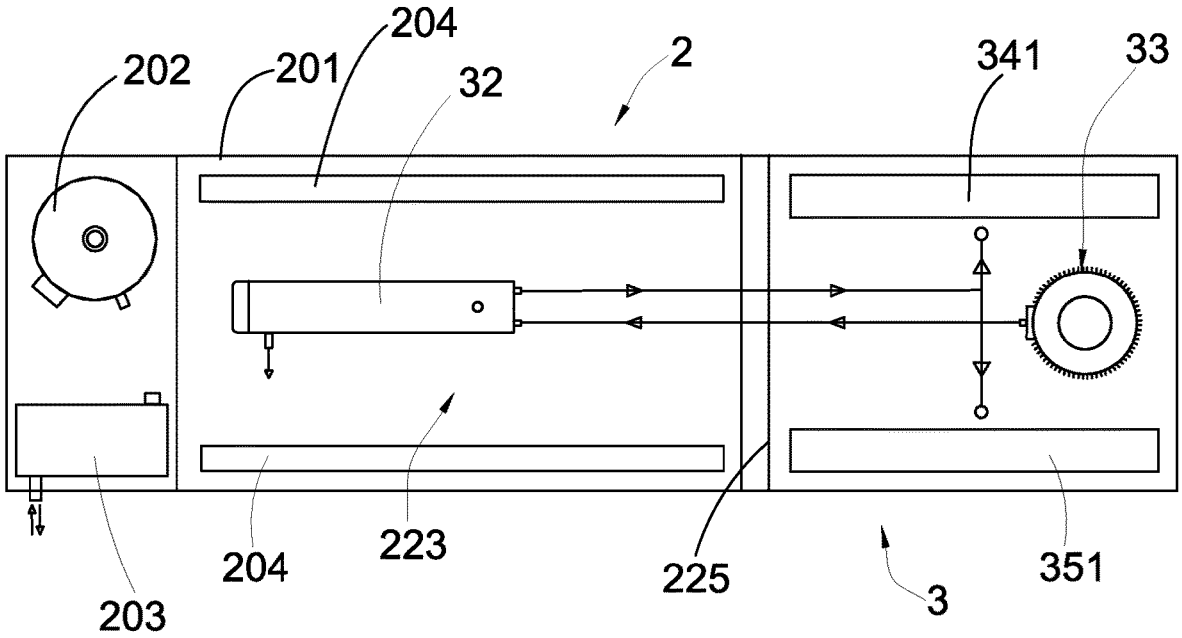
FIG. 7 is a schematic diagram of the central air conditioning and heat pump system according to the first preferred embodiment of the present invention.
Figure 8:
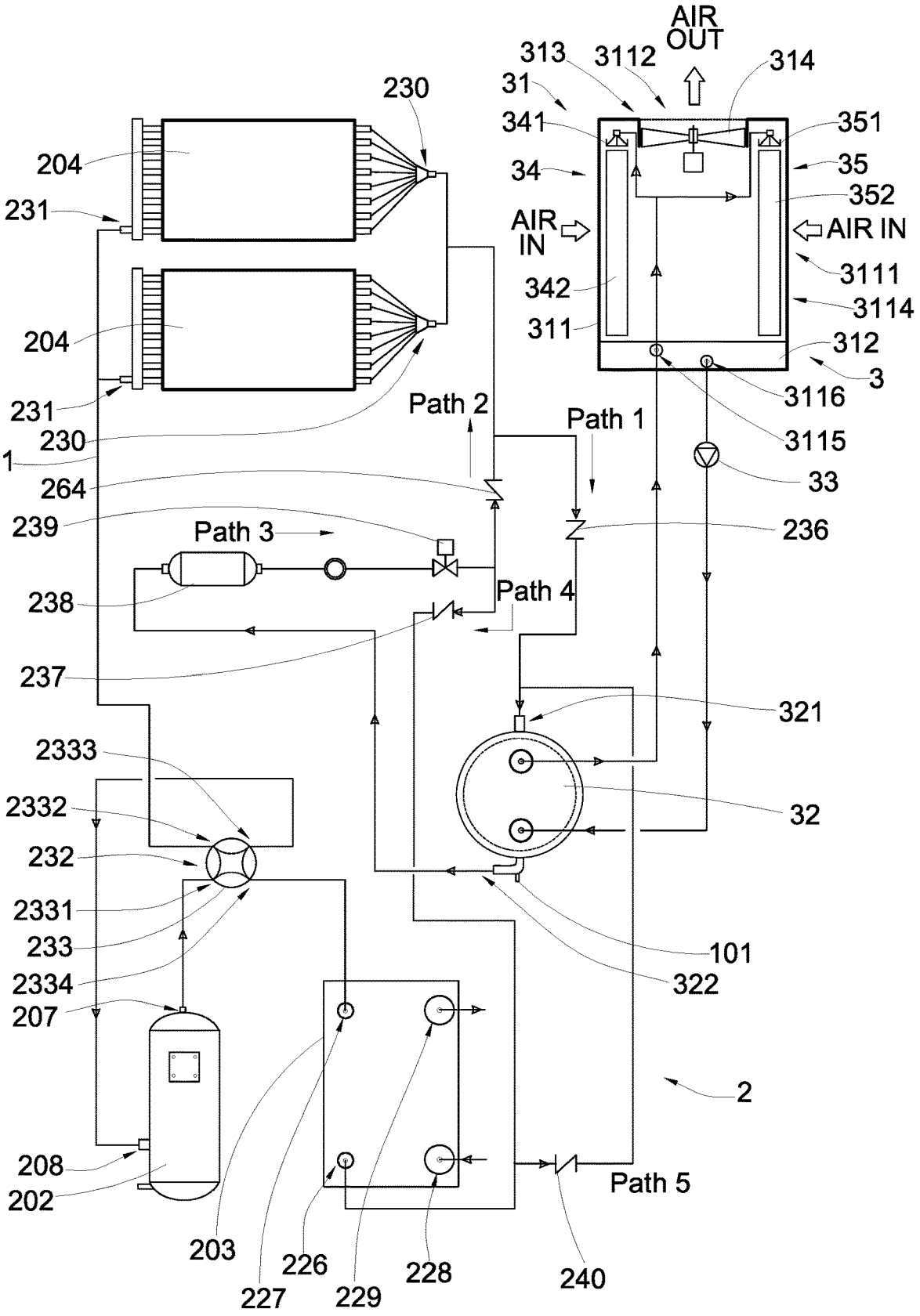
FIG. 8 is a schematic diagram of the central air conditioning and heat pump system according to the first preferred embodiment of the present invention, illustrating a flow path of refrigerant.

Referring to FIG. 6 to FIG. 8 of the drawings, a central air conditioning and heat pump system according to a first preferred embodiment of the present invention is illustrated. Broadly, the central air conditioning and heat pump system may comprise a plurality of connecting pipes 1, a main heat exchange system 2, and a cooling arrangement 3. A predetermined amount of refrigerant may circulate through the various components (described below) of the main heat exchange system 2, while a predetermined amount of water may circulate through various components (described below) of the cooling arrangement 3. The refrigerant and the water may circulate through the various components through a plurality of connecting pipes 1.

The main heat exchange system 2 may comprise a main casing 201, a compressor 202, a first heat exchanger 203, a second heat exchanger 204. The cooling arrangement 3 may comprise a cooling tower 31, a condensing unit 32 and a pump 33 connected between the cooling tower 31 and the condensing unit 32.

The compressor 202 is supported in the main casing 201, and may have a compressor outlet 207 and a compressor inlet 208. The first heat exchanger 203 may be supported in the main casing 201 and connected to the compressor 202 through at least one of the connecting pipes 1. The second heat exchanger 204 may be supported in the main casing 201 and connected to the compressor 202 and the first heat exchanger 203 through at least one of the connecting pipes 1.

The cooling tower 31 of the cooling arrangement 3 may comprise a tower casing 311 having a cooling tower air inlet 3111 and a cooling tower air outlet 3112, a water storage tank 312 provided at a bottom portion of the tower casing 311 for storing a predetermined amount of cooling water, a cooling assembly 313, and a fan 314.

The cooling assembly 313 may comprise a first cooling unit 34 and a second cooling unit 35. The first cooling unit 34 may comprise a first water collection basin 341 connected to the condensing unit 32, and a first fill material unit 342. The cooling water in the condensing unit 32 may be arranged to be pumped to the first water collection basin 341. The first fill material unit 342 may be provided underneath the first water collection basin 341, wherein the cooling water in the first water collection basin 341 may be arranged to be distributed on the first fill material unit 342.

On the other hand, the second cooling unit 35 may comprise a second water collection basin 351 also connected to condensing unit 32, and a second fill material unit 352. The cooling water from the condensing unit 32 may be arranged to be pumped to the second water collection basin 351. The second fill material unit 352 may be provided underneath the second water collection basin 351, wherein the cooling water in the second water collection basin 351 may be arranged to be distributed on the second fill material unit 352 The water storage tank 312 may be provided underneath the first fill material unit 342 and the second fill material unit 352.

The fan 314 may be provided in the tower casing 311 for drawing air to flow from the cooling tower air inlet 3111 to the cooling tower air outlet 3112. The cooling water collected in the water storage tank 312 may be arranged to be guided to flow to the condensing unit 32. At the same time, a predetermined amount of air may be drawn from the cooling tower air inlet 3111 for performing heat exchange with the cooling water flowing through the first fill material unit 342 and the second fill material unit 352 for lowering a temperature of the cooling water. The air having absorbed the heat from the cooling water may be discharged out of the tower casing 311 through the cooling tower air outlet 3112.

The condensing unit 32 may be connected to the cooling tower 31 and the first heat exchanger 203 and the second heat exchanger 204 through at least one of the connecting pipes 1. The condensing unit 32 may be configured to perform heat exchange between the water flowing out of the cooling tower 31 and the refrigerant flowing out from the second heat exchanger 204 or the first heat exchanger 203, as shown in FIG. 8 of the drawings.

The central air conditioning and heat pump system may be selectively operated between a comprehensive air conditioning mode and a heat pump mode. In the comprehensive air conditioning mode, a predetermined amount of vaporous refrigerant is arranged to leave the compressor 202 and guided to enter the second heat exchanger 204 for releasing heat thereto. The refrigerant leaving the second heat exchanger 204 may be guided to flow into the condensing unit 32 for releasing a predetermined amount of heat to the cooling water circulating between the condensing unit 32 and the cooling tower 31. The refrigerant leaving the condensing unit 32 may be guided to flow through the first heat exchanger 203 for absorbing heat from a heat distribution system connected to a designated indoor space. The refrigerant leaving the first heat exchanger 203 may be guided to flow back to the compressor 202 to complete an air conditioning cycle.

When the central air conditioning and heat pump system is in the heat pump mode, a predetermined amount of vaporous refrigerant may be arranged to leave the compressor 202 and guided to flow into the first heat exchanger 203 for releasing heat to the heat distribution system connected to a designated indoor space. The refrigerant leaving the first heat exchanger 203 may be guided to flow into the condensing unit 32. The refrigerant leaving the condensing unit 32 may be guided to flow into the second heat exchanger 204 for absorbing heat from the ambient air. The refrigerant leaving the second heat exchanger 204 may be guided to flow back to the compressor 202 to complete a heat pump cycle.

According to the first preferred embodiment of the present invention, the main casing 201 of the main heat exchange system 2 may be installed on the roof of a building. The central air conditioning and heat pump system of the present invention may be arranged to selectively provide air conditioning and heating to designated indoor spaces in the building. The main casing 201 may have an air cooling compartment 223. The tower casing 311 of the cooling tower 31 may be connected to the main casing 201. The main casing 201 and the tower casing 311 may be separated by a partition 225. As shown in FIG. 7 of the drawings, the compressor 202, the first heat exchanger 203, the second heat exchanger 204 may be supported in the air cooling compartment 223 of the main casing 201.

The fan 314 may be provided on top of the air cooling compartment 223 of the main casing 201 for providing ventilation and allow air passage and heat exchange between the cavity in the air cooling compartment 223 and the ambient atmosphere (described in more details below).

The compressor 202 may be configured to pressurize the refrigerant flowing therethrough. It forms a starting point of refrigerant circulation for a typical air conditioning cycle or a heat pump cycle.

The first heat exchanger 203 may have a first communicating port 226 and a second communicating port 227, and may be configured to perform heat exchange between the refrigerant and another working fluid such as water. The first heat exchanger 203 may be configured to act as an evaporator (i.e. converting the refrigerant into gaseous or vaporous state) when the central air conditioning and heat pump system is operated in the comprehensive air conditioning mode. In the first preferred embodiment, the first heat exchanger 203 may be configured to allow heat exchange between the refrigerant and a heat distribution system so as to extract heat from a designated space. The heat so extracted is to be absorbed by the refrigerant which will be heated and turned into vaporous or gaseous state. The first communicating port 226 and the second communicating port 227 may form as an inlet or outlet for the refrigerant passing through the first heat exchanger 203.

Moreover, the first heat exchanger 203 may further have a third communicating port 228 and a fourth communicating port 229. The third communicating port 228 and the fourth communicating port 229 may be connected to the heat distribution system and serve as an inlet and an outlet for the refrigerant or water circulating through the heat distribution system respectively.

The first heat exchanger 203 may be configured to act as a condenser (i.e. converting the refrigerant into liquid state) when the air conditioning and heat pump system is operated in the heat pump mode. Thus, the first heat exchanger 203 may be configured to allow heat exchange between the refrigerant and the water or refrigerant flowing through the heat distribution system so as to extract heat from the refrigerant.

The heat so extracted is to be absorbed and distributed by the heat distribution system. The central air conditioning and heat pump system may comprise two second heat exchangers 204 connected in parallel. Each of the second heat exchanger 204 may have a first passage port 230 and a second passage port 231, and may be configured to perform heat exchange between the refrigerant and another working fluid such as air. The second heat exchangers 204 may be configured to act as a condenser (i.e. converting the refrigerant into liquid state) when the air conditioning and heat pump system is operated in the comprehensive air conditioning mode. In the first preferred embodiment, the second heat exchangers 204 may be configured to allow heat exchange between the refrigerant and the ambient air drawn by a fan 24 so as to extract heat from the refrigerant. Each of the first passage ports 230 and the second passage ports 231 may form as an inlet or an outlet for the refrigerant passing through the corresponding second heat exchanger 204. The two second heat exchangers 204 may be structurally identical. The fan 24 may be supported by the main casing 201, as shown in FIG. 6 of the drawings.

The second heat exchanger 204 may be configured to act as an evaporator (i.e. converting the refrigerant into vaporous or gaseous state) when the air conditioning and heat pump system is operated in the heat pump mode. Thus, the second heat exchanger 204 may be configured to allow heat exchange between the refrigerant and the ambient air so as to absorb heat from the ambient air.

It is important to note that the compressor 202, the first heat exchanger 203 and the second heat exchanger 204 of the main heat exchange system 2 and the cooling arrangement 3 may be arranged and connected through a plurality of connecting pipes 1 in certain configurations. An exemplary configuration is shown in FIG. 8 of the drawings.

The main heat exchange system 2 may further comprise a switching device 232 connecting between the first heat exchanger 203 and the second heat exchanger 204 for altering a flowing path of the refrigerant. Specifically, the switching device 232 may comprise a first communicative valve 233 having first through fourth connecting port 2331, 2332, 2333, 2334. The first communicative valve 233 may be switched between an air conditioning switching mode and a heat pump switching mode, wherein in the air conditioning switching mode, the first communicative valve 233 is switched such that the first connecting port 2331 may be connected to the second connecting port 2332 so that refrigerant may flow from the first connecting port 2331 to the second connecting port 2332, while the third connecting port 2333 may be connected to the fourth connecting port 2334 so that refrigerant may flow from the third first connecting port 2333 to the fourth connecting port 2334.

In the heat pump switching mode, the first communicative valve 233 may be switched so that the first connecting port 2331 may be connected to the fourth connecting port 2334 so that refrigerant may flow from the first connecting port 2331 to the fourth connecting port 2334, while the second connecting port 2332 may be connected to the third connecting port 2333, so that refrigerant may flow from the second connecting port 2332 to the third connecting port 2333.

As shown in FIG. 8 of the drawings, the first connecting port 2331 may be connected to the compressor outlet 207 of the compressor 202. The second connecting port 2332 may be connected to the second passage ports 231 of the second heat exchangers 204. The third connecting port 2333 may be connected to the compressor inlet 208 of the compressor 202. The fourth connecting port 2334 may be connected to the second communicating port 227 of the first heat exchanger 203.

The first passage ports 230 of the second heat exchangers 204 may be connected to the first communicating port 226 of the first heat exchanger 203 through various components connected in series. An exemplary configuration is shown in FIG. 8 of the drawings. The condensing unit 32 may have a first condensing unit port 321 and a second condensing unit port 322. The first communicating port 226 of the first heat exchanger 203 may also be connected to the first condensing unit port 321 of the condensing unit 32.

The second heat exchangers 204 may be connected to the condensing unit 32 and the first heat exchanger 203 in parallel and through several other components. For the sake of clarity, the refrigerant leaving the second heat exchanger 204 may either enter Path 1 or Path 2 as shown in FIG. 8. However, the main heat exchange system 2 may further comprise a first unidirectional valve 236 connected between the first passage ports 230 of the second heat exchangers 204 and the first condensing unit port 321 of the condensing unit 32 in Path 1. The first unidirectional valve 236 may be configured to restrict the flow of refrigerant in one predetermined direction, and not vice versa. In the first preferred embodiment, the first unidirectional valve 236 may be configured to allow refrigerant to flow from the second heat exchanger 204 toward the condensing unit 32 through Path 1 only. Thus, the refrigerant may enter the first condensing unit port 321 of the condensing unit 32 through Path 1.

The second condensing unit port 322 of the condensing unit 32 may be connected to the first passage ports 230 and the first communicating port 226. As shown in FIG. 8 of the drawings, the refrigerant flowing out from the second condensing unit port 322 may travel through Path 3 and reach an intersection between Path 2 (which allows the refrigerant to travel to the first passage ports 230) and Path 4 (which allows the refrigerant to travel to the first communicating port 226).

In this respect, the main heat exchange system 2 may further comprise a second unidirectional valve 237 connected to Path 4 and a fourth unidirectional valve 264 connected to Path 2. Thus, the fourth unidirectional valve 264 may be connected to the first passage ports 230 and may be configured to allow refrigerant to flow in the direction from Path 3 to Path 2 toward the first passage ports 230 only. On the other hand, the second unidirectional valve 237 may be connected to the fourth unidirectional valve 264 and may be configured to allow refrigerant to flow in the direction from Path 3 to Path 4 toward the first communicating port 226 only.

The main heat exchange system 2 may further comprise a filter 238 connected to the second condensing unit port 322 of the condensing unit 32 in Path 3. The filter 238 may be configured to filter unwanted substances from the refrigerant which pass through them. The refrigerant coming out from the second condensing unit port 322 may sequentially pass through Path 3 and either Path 2 or Path 4 and eventually reach the first passage ports 230 of the second heat exchangers 204 or the first communicating port 226.

The main heat exchange system 2 may further comprise an expansion valve 239 connected to the filter 238 in Path 3. The expansion valve 239 may be configured to control and regulate the flow of the refrigerant passing through them. Thus, the refrigerant passing through Path 3 may be guided to flow through the filing device 238 and the expansion valve 239.

The main heat exchange system 2 may further comprise a third unidirectional valve 240 connected between the first heat exchanger 203 and the condensing unit 32. Specifically, the third unidirectional valve 240 may be connected between the first communicating port 226 of the first heat exchanger 203 and the first condensing unit port 321 of the condensing unit 32 through Path 5. In this preferred embodiment, the third unidirectional valve 240 may be configured such that it may only allow refrigerant to flow in a direction from the first communicating port 226 toward the first condensing unit port 321.

The heat distribution system may be arranged to retrieve the heat generated by the main heat exchange system 2 and distribute the heat to designated indoor spaces through at least one terminal device. One of such terminal devices may be a ventilating device. The ventilating device may be utilized for delivering ambient air to the indoor space when the central air conditioning and heat pump system is operated in the heat pump mode.

According to the first preferred embodiment of the present invention, the cooling tower 31 may be installed to lower the temperature of refrigerant circulating in the condensing unit 32.

The tower casing 311 may have a rectangular cross section having a top side 3113, a bottom side and a plurality of peripheral sides 3114. Obviously, the tower casing 311 may be embodied as having a wide variety of cross sections for suiting different operational environments.

The pump 33 may be connected between the condensing unit 32 and the cooling tower 31 for circulating cooling water between the cooling tower 31 and the condensing unit 32.

As shown in FIG. 8 of the drawings, the tower casing 311 may further have a cooling tower water inlet 3115 and a cooling tower water outlet 3116. The cooling tower water inlet 3115 may communicate the first water collection basin 341 and the second water collection basin 351 with the condensing unit 32. Cooling water from the condensing unit 32 may be guided to flow through the cooling tower water inlet 3115 and is distributed to each of the first water collection basin 341 and the second water collection basin 351 through a plurality of connecting pipes 1.

Moreover, the condensing unit 32 of the cooling arrangement 3 may further comprise a temperature control sensor 101 provided at the second condensing unit port 322 for detecting a temperature of the cooling water leaving the condensing unit 32. When a temperature of the cooling water is lower than a predetermined threshold (such as 38° C.), the fan 314 and the pump 33 may be turned off.

The operation of the present invention is as follows: the central air conditioning and heat pump system described above involves a refrigerant flowing cycle and a water flowing cycle. The refrigerant may flow through the various components of the main heat exchange system 2 while the water may flow through the various components of the cooling arrangement 3.

When the central air conditioning and heat pump system is in the comprehensive air conditioning mode, it is configured to generate cool air to designated indoor spaces. A refrigerant cycle starts from the compressor 202. Superheated or vaporous refrigerant may be arranged to leave the compressor 202 through the compressor outlet 207. The first communicative valve 233 may be switched to the air conditioning switching mode. The refrigerant leaving the compressor 202 may pass through the first connecting port 2331 of the first communicative valve 233, the second connecting port 2332, and enter the second heat exchangers 204 through the second passage ports 231. The refrigerant may then perform heat exchange with a coolant such as ambient air so as to release heat to ambient air.

The refrigerant may then be guided to exit the second heat exchangers 204 through the first passage ports 230. The refrigerant leaving the second heat exchangers 204 may then be guided to flow through the first unidirectional valve 236 in Path 1 and enter the condensing unit 32 through the first condensing unit port 321. The refrigerant may be prevented from entering path 2 by the fourth unidirectional valve 264 at this time. The refrigerant may be arranged to further release heat to the cooling water circulating in the condensing unit 32. The heat released to the condensing unit 32 may be carried away by the cooling water circulating between the cooling tower 31 and the condensing unit 32.

The refrigerant leaving the condensing unit 32 through the second condensing unit port 322 may then be guided to pass through filter 238 and the expansion valve 239 connected in Path 3, the second unidirectional valve 237 in Path 4, and eventually enter the first heat exchanger 203 through the first communicating port 226. The refrigerant entering the first heat exchanger 203 may then be arranged to perform heat exchange with another heat exchange medium circulating in the heat distribution system so as to absorb heat from therefrom. The refrigerant may then be guided to leave the first heat exchanger 203 through the second communicating port 227. The refrigerant may then be guided to flow through the fourth connecting port 2334 and the third connecting port 2333 of the first communicative valve 233 and eventually flow back to the compressor 202 through the compressor inlet 208. This completes one refrigerant cycle for the comprehensive air conditioning mode.

It is worth mentioning that the condensing unit 32 may be utilized for further cooling the temperature of the refrigerant through heat exchange with the cooling water coming from the cooling tower 31. The pump 33 may pump cooling water to circulate between the condensing unit 32 and the cooling tower 31. Specifically, cooling water in the condensing unit 32 may be pumped to the first water collection basin 341 and the second water collection basin 351 through the cooling water tower inlet 3115. The cooling water collected in the first water collection basin 341 and the second water collection basin 351 may be arranged to be distributed on the first fill material unit 342 and the second fill material unit 352 for forming a thin film of water in the first fill material unit 342 and the second fill material unit 352. At the same time, ambient air is drawn by the fan 314 to flow from the cooling tower air inlet 3111 to the cooling tower air outlet 3112 for allowing heat exchange between the ambient air and the water flowing in the first fill material unit 342 and the second fill material unit 352. The temperature of the water flowing in the first fill material unit 342 and the second fill material unit 352 will be lowered and collected in a bottom water storage tank 312 provided underneath the first fill material unit 342 and the second fill material unit 352. Heat from the cooling water flowing through the first fill material unit 342 and the second fill material unit 352 will be released to the ambient air. The water storage tank 312 may communicate with the cooling water tower outlet 3116. The water in the water storage tank 312 may then be guided to flow back to the condensing unit 32 through the cooling water tower outlet 3116 for another heat exchange cycle.

From the above descriptions, one skilled in the art may appreciate that the refrigerant circulating in the main heat exchange system 2 of the present invention may be cooled by either the second heat exchangers 204, the condensing unit 32, or both. In the event that water supply is interrupted, the fan 314 and the pump 33 may also be turned off so that the refrigerant will only be cooled by the second heat exchangers 204.

Note that the comprehensive air conditioning mode implies that the refrigerant circulating in the main heat exchange system 2 may be cooled by water (cooling tower 31) as well as air (second heat exchangers 204).

When the central air conditioning and heat pump system is in the heat pump mode, it is configured to generate heat to designated indoor spaces. The corresponding refrigerant cycle also starts from the compressor 202. Superheated or vaporous refrigerant may be arranged to leave the compressor 202 through the compressor outlet 207. The first communicative valve 233 may be switched to heat pump mode. The refrigerant leaving the compressor 202 may pass through the first connecting port 2331, the fourth connecting port 2334, and enter the first heat exchanger 203 through the second communicating port 227. The refrigerant may then perform heat exchange with the water so as to release heat to the water circulating in the first heat exchanger 203. The refrigerant may be converted into liquid state after releasing heat. The refrigerant may then be guided to exit the first heat exchanger 203 through the first communicating port 226. The refrigerant leaving the first heat exchanger 203 may then be guided to flow through the third unidirectional valve 240 in Path 5 and the condensing unit 32 through the first condensing unit port 321.

When the central air conditioning and heat pump system is in the heat pump mode, the fan 314 and the pump 3 may be turned off. In addition, the cooling water may be discharged out of the cooling tower 31. The condensing unit 32 may thus be converted into a storage tank. The refrigerant will then be guided to leave the condensing unit 32 through the second condensing unit port 322. The refrigerant may then be guided to flow through the filter 238 and the expansion valve 239 connected in Path 3. The refrigerant may then be guided to pass through the fourth unidirectional valve 264 connected in Path 2 and eventually reach the second heat exchangers 204 through the corresponding first passage port 230 for absorbing heat from the ambient air. The refrigerant may then exit the second heat exchangers 204 through the second passage ports 231 and may be guided to flow through the second connecting port 2332 of the first communicative valve 233, the third connecting port 2333, and eventually go back to the compressor 202 through the compressor inlet 208. This completes one refrigerant cycle in the heat pump mode.

The central air conditioning and heat pump system may further operate in a defrosting mode. The defrosting mode may be utilized to remove frost which may be formed on the second heat exchanger 204 when the central air conditioning and heat pump system is operated in the heat pump mode. In the defrosting mode, the corresponding refrigerant cycle also starts from the compressor 202. Superheated or vaporous refrigerant may be arranged to leave the compressor 202 through the compressor outlet 207. The first communicative valve 233 may be switched to the comprehensive air conditioning mode. The refrigerant leaving the compressor 202 may pass through the first connecting port 2331, the second connecting port 2332, and enter the second heat exchangers 204 through the second passage ports 231 for releasing heat to defrost the second heat exchangers 204. The refrigerant may exit the second heat exchangers 204 through the first passage ports 230 and may be guided to pass through the first unidirectional valve 236 connected in Path 1. The refrigerant may then be guided to enter the condensing unit 32 through the first condensing unit port 321 and exit the condensing unit 32 through the second condensing unit port 322. The fan 314 and the pump 33 may be turned off, and the condensing unit 32 may also be just a storage tank.

The refrigerant leaving the condensing unit 32 may then be guided to pass through the filter 238 and the expansion valve 239 connected in Path 3. The refrigerant may then be guided to pass through the second unidirectional valve 237 in Path 4 and enter the first heat exchanger 203 through the first communicating port 226. The refrigerant leaving the first heat exchanger 203 through the second communicating port 227 may then be guided to flow through the fourth connecting port 2334 of the first communicative valve 233, the third connecting port 2333, and eventually go back to the compressor 202 through the compressor inlet 208. This completes one refrigerant cycle in the defrosting mode.

Figure 9:
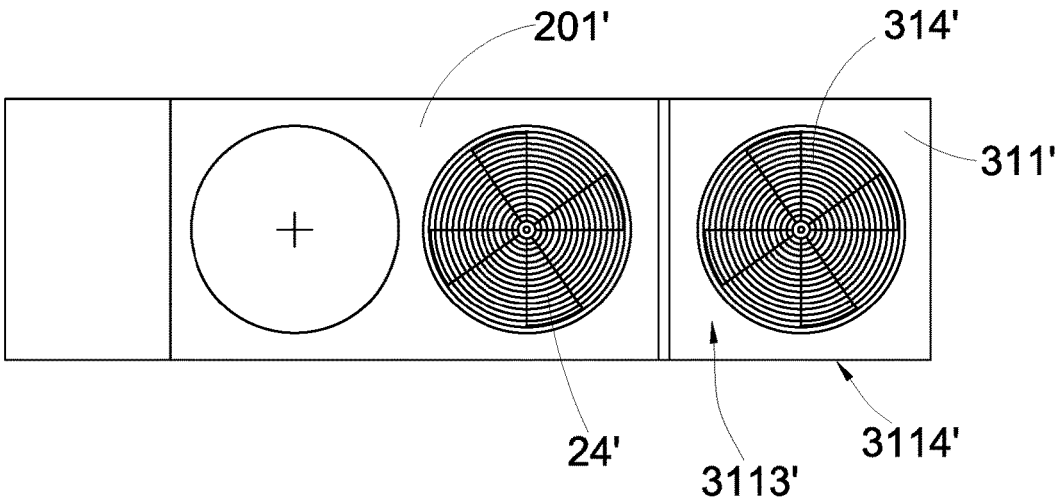
FIG. 9 is a top view of a central air conditioning and heat pump system according to a second preferred embodiment of the present invention.
Figure 10:
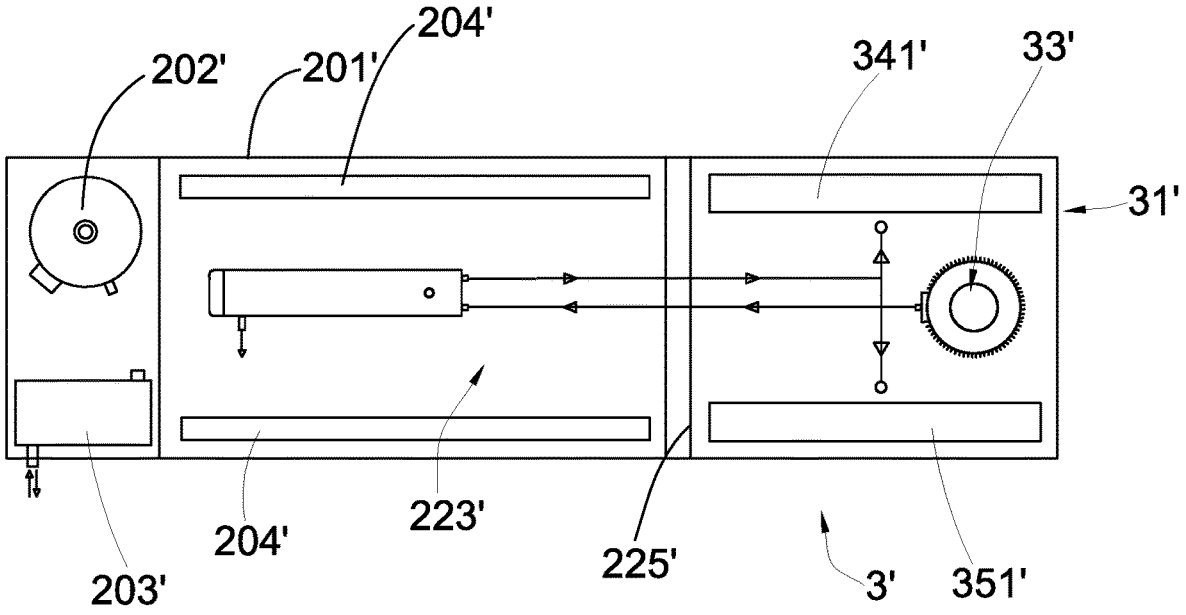
FIG. 10 is a schematic diagram of the central air conditioning and heat pump system according to the second preferred embodiment of the present invention.
Figure 11:
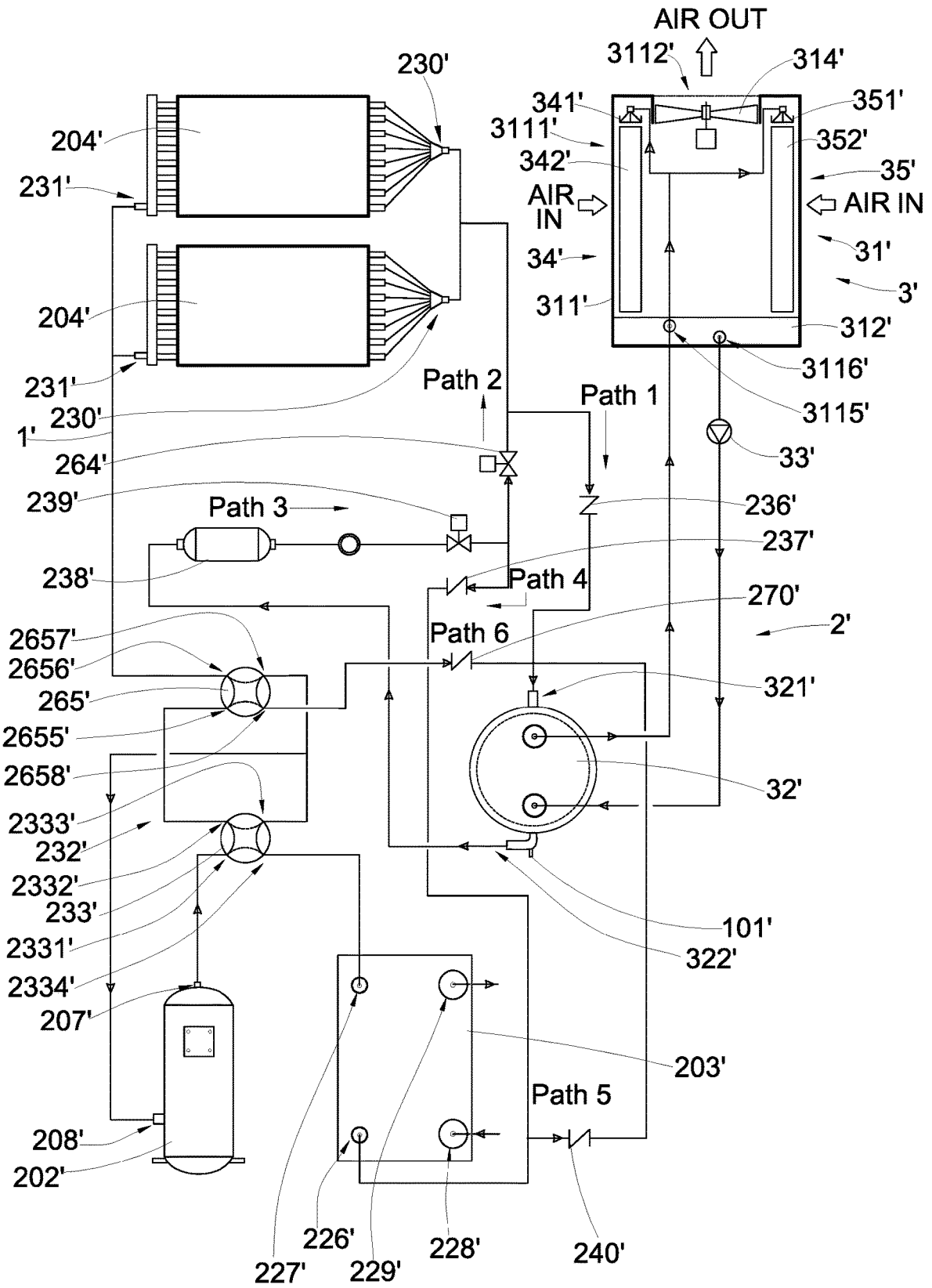
FIG. 11 is a schematic diagram of the central air conditioning and heat pump system according to the second preferred embodiment of the present invention, illustrating a flow path of refrigerant.

Referring to FIG. 9 to FIG. 11 of the drawings, the central air conditioning and heat pump system according to a second preferred embodiment of the present invention is illustrated. The second preferred embodiment is similar to that of the first preferred embodiment described above, except the switching device 232' may further comprise a second communicative valve 265' connected to the second heat exchangers 204', the first communicative valve 233', and the condensing unit 32'. With the introduction of one more communicative valve, the flowing path of the refrigerant is different from that of the first preferred embodiment.

As in the first preferred embodiment, the central air conditioning and heat pump system may comprise a plurality of connecting pipes 1', a main heat exchange system 2', and a cooling arrangement 3'. A predetermined amount of refrigerant may circulate through the various components (described below) of the main heat exchange system 2', while a predetermined amount of water may circulate through various components (described below) of the cooling arrangement 3'. The refrigerant and the water may circulate through the various components through a plurality of connecting pipes 1'.

The main heat exchange system 2' may comprise a main casing 201', a compressor 202', a first heat exchanger 203', a second heat exchanger 204'. The cooling arrangement 3' may comprise a cooling tower 31', a condensing unit 32' and a pump 33' connected between the cooling tower 31' and the condensing unit 32'.

The compressor 202' is supported in the main casing 201', and may have a compressor outlet 207' and a compressor inlet 208'. The first heat exchanger 203' may be supported in the main casing 201' and connected to the compressor 202' through at least one of the connecting pipes 1'. The second heat exchanger 204' may be supported in the main casing 201' and connected to the compressor 202' and the first heat exchanger 203' through at least one of the connecting pipes 1'.

The cooling tower 31' of the cooling arrangement 3' may comprise a tower casing 311' having a cooling tower air inlet 3111' and a cooling tower air outlet 3112', a water storage tank 312' provided at a bottom portion of the tower casing 311' for storing a predetermined amount of cooling water, a cooling assembly 313', and a fan 314'.

The cooling assembly 313' may comprise a first cooling unit 34' and a second cooling unit 35'. The first cooling unit 34' may comprise a first water collection basin 341' connected to the condensing unit 32', and a first fill material unit 342'. The cooling water in the condensing unit 32' may be arranged to be pumped to the first water collection basin 341'. The first fill material unit 342' may be provided underneath the first water collection basin 341', wherein the cooling water in the first water collection basin 341' may be arranged to be distributed on the first fill material unit 342'.

On the other hand, the second cooling unit 35' may comprise a second water collection basin 351' also connected to condensing unit 32', and a second fill material unit 352'. The cooling water from the condensing unit 32' may be arranged to be pumped to the second water collection basin 351'. The second fill material unit 352' may be provided underneath the second water collection basin 351', wherein the cooling water in the second water collection basin 351' may be arranged to be distributed on the second fill material unit 352' The water storage tank 312' may be provided underneath the first fill material unit 342' and the second fill material unit 352'.

The fan 314' may be provided in the tower casing 311' for drawing air to flow from the cooling tower air inlet 3111' to the cooling tower air outlet 3112'. The cooling water collected in the water storage tank 312' may be arranged to be guided to flow to the condensing unit 32'. At the same time, a predetermined amount of air may be drawn from the cooling tower air inlet 3111' for performing heat exchange with the cooling water flowing through the first fill material unit 342' and the second fill material unit 352' for lowering a temperature of the cooling water. The air having absorbed the heat from the cooling water may be discharged out of the tower casing 311' through the cooling tower air outlet 3112'.

The condensing unit 32' may be connected to the cooling tower 31' and the first heat exchanger 203' and the second heat exchanger 204' through at least one of the connecting pipes 1'. The condensing unit 32' may be configured to perform heat exchange between the water flowing out of the cooling tower 31' and the refrigerant flowing out from the second heat exchanger 204', as shown in FIG. 11 of the drawings.

The central air conditioning and heat pump system may be selectively operated between a comprehensive air conditioning mode, a water-cooled air conditioning mode, an air-cooled air conditioning mode, and a heat pump mode. The major difference between the first preferred embodiment and the second preferred embodiment is that in the second preferred embodiment, the air conditioning mode may be divided into a comprehensive air conditioning mode, a water-cooled air conditioning mode, and an air-cooled air conditioning mode.

In the comprehensive air conditioning mode, refrigerant circulating in the main heat exchange system 2' may be cooled by the second heat exchangers 204' (cooled by air) and the cooling tower 31' (cooled by cooling water). In the water-cooled air conditioning mode, the refrigerant circulating in the main heat exchange system 2' may be cooled by the cooling tower 31' alone. In the air-cooled air conditioning mode, the refrigerant circulating in the main heat exchange system 2' may be cooled by the second heat exchangers 204' alone.

Thus, in the comprehensive air conditioning mode, a predetermined amount of vaporous refrigerant may be arranged to leave the compressor 202' and guided to enter the second heat exchanger 204' for releasing heat thereto. The refrigerant leaving the second heat exchanger 204' may be guided to flow into the condensing unit 32' for further releasing a predetermined amount of heat to the cooling water circulating between the condensing unit 32' and the cooling tower 31'. The refrigerant leaving the condensing unit 32' may be guided to flow through the first heat exchanger 203' for absorbing heat from a heat distribution system connected to a designated indoor space. The refrigerant leaving the first heat exchanger 203' may be guided to flow back to the compressor 202' to complete a comprehensive air conditioning cycle.

In the water-cooled air conditioning mode, a predetermined amount of vaporous refrigerant may be arranged to leave the compressor 202' and guided to enter the condensing unit 32' for releasing a predetermined amount of heat to the cooling water circulating between the condensing unit 32' and the cooling tower 31'. The refrigerant leaving the condensing unit 32' may be guided to flow through the first heat exchanger 203' for absorbing heat from a heat distribution system connected to a designated indoor space. The refrigerant leaving the first heat exchanger 203' may be guided to flow back to the compressor 202' to complete an air conditioning cycle.

In the air-cooled air conditioning mode, a predetermined amount of vaporous refrigerant may be arranged to leave the compressor 202' and guided to enter the second heat exchangers 204' for releasing heat thereto. The refrigerant leaving the second heat exchangers 204' may be guided to flow through the first heat exchanger 203' for absorbing heat from a heat distribution system connected to a designated indoor space. The refrigerant leaving the first heat exchanger 203' may be guided to flow back to the compressor 202' to complete an air conditioning cycle.

When the central air conditioning and heat pump system is in the heat pump mode, a predetermined amount of vaporous refrigerant may be arranged to leave the compressor 202' and guided to flow into the first heat exchanger 203' for releasing heat to the heat distribution system connected to a designated indoor space. The refrigerant leaving the first heat exchanger 203' may be guided to flow into the condensing unit 32'. The refrigerant leaving the condensing unit 32' may be guided to flow into the second heat exchanger 204' for absorbing heat from the ambient air. The refrigerant leaving the second heat exchanger 204' may be guided to flow back to the compressor 202' to complete a heat pump cycle.

According to the second preferred embodiment of the present invention, the main casing 201' of the main heat exchange system 2' may be installed on the roof of a building. The central air conditioning and heat pump system of the present invention may be arranged to selectively provide air conditioning and heating to designated indoor spaces in the building. The main casing 201' may have an air cooling compartment 223'. The tower casing 311' may be connected to the main casing 201'. The main casing 201' and the tower casing 311' may be separated by a partition 225'. As shown in FIG. 9 to FIG. 10 of the drawings, the compressor 202', the first heat exchanger 203', the second heat exchangers 204' may be supported in the air cooling compartment 223' of the main casing 201'.

The fan 314' may be provided on top of the air cooling compartment 223' of the main casing 201' for providing ventilation and allow air passage and heat exchange between the cavity in the air cooling compartment 223' and the ambient atmosphere.

The compressor 202' may be configured to pressurize the refrigerant flowing therethrough. It forms a starting point of refrigerant circulation for a typical air conditioning cycle or a heat pump cycle.

The first heat exchanger 203' may have a first communicating port 226' and a second communicating port 227', and may be configured to perform heat exchange between the refrigerant and another working fluid such as water. The first heat exchanger 203' may be configured to act as an evaporator (i.e. converting the refrigerant into gaseous or vaporous state) when the central air conditioning and heat pump system is operated in the comprehensive air conditioning mode, the water-cooled air conditioning mode, or the air-cooled air conditioning mode. In the second preferred embodiment, the first heat exchanger 203' may be configured to allow heat exchange between the refrigerant and a heat distribution system so as to extract heat from a designated space. The heat so extracted is to be absorbed by the refrigerant which will be heated and turned into vaporous or gaseous state. The first communicating port 226' and the second communicating port 227' may form as an inlet or outlet for the refrigerant passing through the first heat exchanger 203'.

Moreover, the first heat exchanger 203' may further have a third communicating port 228' and a fourth communicating port 229'. The third communicating port 228' and the fourth communicating port 229' may be connected to the heat distribution system and serve as an inlet and an outlet for the refrigerant or water circulating through the heat distribution system respectively.

The first heat exchanger 203' may be configured to act as a condenser (i.e. converting the refrigerant into liquid state) when the air conditioning and heat pump system is operated in the heat pump mode. Thus, the first heat exchanger 203' may be configured to allow heat exchange between the refrigerant and the water or refrigerant flowing through the heat distribution system so as to extract heat from the refrigerant. The heat so extracted is to be absorbed and distributed by the heat distribution system.

The central air conditioning and heat pump system may comprise two second heat exchangers 204' connected in parallel. Each of the second heat exchanger 204' may have a first passage port 230' and a second passage port 231', and may be configured to perform heat exchange between the refrigerant and another working fluid such as air. The second heat exchangers 204' may be configured to act as a condenser (i.e. converting the refrigerant into liquid state) when the air conditioning and heat pump system is operated in the comprehensive air conditioning mode, the water-cooled air conditioning mode, or the air-cooled air conditioning mode. In the second preferred embodiment, the second heat exchangers 204' may be configured to allow heat exchange between the refrigerant and the ambient air drawn by a fan 24' so as to extract heat from the refrigerant. Each of the first passage ports 230' and the second passage ports 231' may form as an inlet or an outlet for the refrigerant passing through the corresponding second heat exchanger 204'. The two second heat exchangers 204' may be structurally identical. The fan 24' may be supported by the main casing 201', as shown in FIG. 9 of the drawings.

The second heat exchanger 204' may be configured to act as an evaporator (i.e. converting the refrigerant into vaporous or gaseous state) when the air conditioning and heat pump system is operated in the heat pump mode. Thus, the second heat exchanger 204' may be configured to allow heat exchange between the refrigerant and the ambient air so as to absorb heat from the ambient air.

It is important to note that the compressor 202', the first heat exchanger 203' and the second heat exchanger 204' of the main heat exchange system 2' and the cooling arrangement 3' may be arranged and connected through a plurality of connecting pipes 1' in certain configurations. An exemplary configuration is shown in FIG. 11 of the drawings.

The main heat exchange system 2' may further comprise a switching device 232' connecting between the first heat exchanger 203' and the second heat exchanger 204' for altering a flowing path of the refrigerant. Specifically, the switching device 232' may comprise a first communicative valve 233' having first through fourth connecting port 2331', 2332', 2333', 2334'. The first communicative valve 233' may be switched between an air conditioning switching mode and a heat pump switching mode, wherein in the air conditioning switching mode, the first communicative valve 233' is switched such that the first connecting port 2331' may be connected to the second connecting port 2332' so that refrigerant may flow from the first connecting port 2331' to the second connecting port 2332', while the third connecting port 2333' may be connected to the fourth connecting port 2334' so that refrigerant may flow from the third connecting port 2333' to the fourth connecting port 2334'.

In the heat pump switching mode, the first communicative valve 233' may be switched so that the first connecting port 2331' may be connected to the fourth connecting port 2334' so that refrigerant may flow from the first connecting port 2331' to the fourth connecting port 2334', while the second connecting port 2332' may be connected to the third connecting port 2333', so that refrigerant may flow from the second connecting port 2332' to the third connecting port 2333'.

According to the second preferred embodiment of the present invention, the second communicative valve 265' may have fifth through eighth connecting port 2655', 2656', 2657', 2658', and may be switched between an air conditioning switching mode and a heat pump switching mode. In the air conditioning switching mode, the second communicative valve 265' may be switched such that the fifth connecting port 2655' may be connected to the sixth connecting port 2656' so that refrigerant may flow from the fifth connecting port 2655' to the sixth connecting port 2656', while the seventh connecting port 2657' may be connected to the eighth connecting port 2658' so that refrigerant may flow from the seventh connecting port 2657' to the eighth connecting port 2658'. On the other hand, in the heat pump switching mode, the second communicative valve 265' may be switched such that the fifth connecting port 2655' may be connected to the eighth connecting port 2658' so that refrigerant may flow from the fifth connecting port 2655' to the eighth connecting port 2658', while the sixth connecting port 2656' may be connected to the seventh connecting port 2657' so that refrigerant may flow from the sixth connecting port 2656' to the seventh connecting port 2657'.

The first connecting port 2331' may be connected to the compressor outlet 207' of the compressor 202'. The second connecting port 2332' may be connected to the fifth connecting port 2655' of the second communicative valve 265'. The third connecting port 2333' may be connected to the seventh connecting port 2657' of the second communicative valve 265'. The fourth connecting port 2334' may be connected to the second communicative port 227' of the first heat exchanger 203'.

On the other hand, the sixth connecting port 2656' may be connected to the second passage ports 231 of the second heat exchanger 204'. The eighth connecting port 2658' may be connected to the first communicating port 226' of the first heat exchanger 203' and the first passage ports 230' of the second heat exchangers 204'.

Moreover, the first passage ports 230' of the second heat exchangers 204' may be connected to the first communicating port 226' of the first heat exchanger 203' through various components connected in series. The condensing unit 32' may have a first condensing unit port 321' and a second condensing unit port 322'.

The second heat exchangers 204' may be connected to the condensing unit 32' and the first heat exchanger 203' in parallel and through several other components. For the sake of clarity, the refrigerant leaving the second heat exchanger 204' may either enter Path 1 or Path 2 as shown in FIG. 11 of the drawings. The refrigerant may enter the first condensing unit port 321' of the condensing unit 32' through Path 1. Alternatively, the refrigerant may be connected to the first communicating port 226' of the first heat exchanger 203' and the second condensing unit port 322' through Path 2 and Path 3 (described in more details below).

The main heat exchange system 2' may further comprise a first unidirectional valve 236' connected between the first passage ports 230' of the second heat exchangers 204' and the first condensing unit port 321' of the condensing unit 32' in Path 1. Furthermore, the main heat exchange system 2' may further comprise an electronic two-way valve 264' connected between the first passage ports 230' of the second heat exchangers 204' and the first communicating port 226' of the first heat exchanger 203' in Path 2, and between the first communicating port 226' of the first heat exchanger 203' and the second condensing unit port 322' through Path 3.

The first unidirectional valve 236' may be configured to restrict the flow of refrigerant in one predetermined direction, and not vice versa. The electronic two-way valve 264' may be configured to selectively restrict the flow of refrigerant in one predetermined direction, and not vice versa.

In the second preferred embodiment of the present invention, the first unidirectional valve 236' may be configured to allow refrigerant to flow from the second heat exchanger 204' toward the condensing unit 32' through Path 1.

The second condensing unit port 322' of the condensing unit 32' may be connected to the first passage port 230' of the second heat exchanger 204' through Path 3, which is defined by a connection pipe 1' connecting the second condensing unit port 322' of the condensing unit 32' to Path 2. The main heat exchange system 2' may further comprise a filter 238' connected to the second condensing unit port 322' of the condensing unit 32' in Path 3. The filter 238' may be configured to filter unwanted substances from the refrigerant which pass through them. The refrigerant coming out from the second condensing unit port 322' may sequentially pass through Path 3 and Path 2 and eventually reach the first passage ports 230' of the second heat exchangers 204'. Thus, the electronic two-way valve 264' may be configured to allow refrigerant to flow in the direction from Path 3 to Path 2 and eventually to the second heat exchanger 204'.

The main heat exchange system 2' may further comprise an expansion valve 239' connected to the filter 238' in Path 3. The expansion valve 239' may be configured to control and regulate the flow of the refrigerant passing through them. Thus, the refrigerant passing through Path 3 may be guided to flow through the filing device 238' and the expansion valve 239'.

The main heat exchange system 2' may further comprise a third unidirectional valve 240' connected between the eighth connecting port 2658' of the second communicative valve 265' and the first heat exchanger 203' and the first condensing unit port 321' of the condensing unit 32'. Specifically, the third unidirectional valve 240' may be configured to allow refrigerant to flow from the first communicating port 226' to the first condensing unit port 321' through Path 5 shown in FIG. 11 of the drawings.

The main heat exchange system 2' may further comprise a fifth unidirectional valve 270' connected between the eighth connecting port 2658' of the second communicative valve 265' and the first heat exchanger 203' and the first condensing unit port 321' of the condensing unit 32'. Specifically, the fifth unidirectional valve 270' may be configured to allow refrigerant to flow from the eighth connecting port 2658' to the first condensing unit port 321' through Path 6 shown in FIG. 11 of the drawings.

The tower casing 311' may have a rectangular cross section having a top side 3113', a bottom side and a plurality of peripheral sides 3114'. Obviously, the tower casing 311' may be embodied as having a wide variety of cross sections for suiting different operational environments.

The pump 33' may be connected between the condensing unit 32' and the cooling tower 31' for circulating cooling water between the cooling tower 31' and the condensing unit 32'.

As in the first preferred embodiment described above, the tower casing 311' may further have a cooling tower water inlet 3115' and a cooling tower water outlet 3116'. The cooling tower water inlet 3115' may communicate the first water collection basin 341' and the second water collection basin 351' with the condensing unit 32'. Cooling water from the condensing unit 32' may be guided to flow through the cooling tower water inlet 3115' and is distributed to each of the first water collection basin 341' and the second water collection basin 351' through a plurality of connecting pipes 1'.

Moreover, the condensing unit 32' of the cooling arrangement 3' may further comprise a temperature control sensor 101' provided at the second condensing unit port 322' for detecting a temperature of the cooling water leaving the condensing unit 32'. When a temperature of the cooling water is lower than a predetermined threshold (such as 38° C.), the fan 314' and the pump 33' may be turned off.

The main heat exchange system 2' may further comprise a second unidirectional valve 237' connected between the electronic two-way valve 264' and the first communicating port 226' of the first heat exchanger 203' in Path 4 indicated in FIG. 11 of the drawings.

The operation of the present invention according to the second preferred embodiment is described as follows: the central air conditioning and heat pump system described above involves a refrigerant flowing cycle and a water flowing cycle. The refrigerant flows through the various components of the main heat exchange system 2' while the water flows through the various components of the cooling arrangement 3'. In the second preferred embodiment of the present invention, the central air conditioning and heat pump system may be operated in a comprehensive air conditioning mode, a water-cooled air conditioning mode, an air-cooled air conditioning mode, a heat pump mode, and a defrosting mode.

When the central air conditioning and heat pump system is in the comprehensive air conditioning mode, it is configured to generate cool air to designated indoor spaces. A refrigerant cycle may start from the compressor 202'. Superheated or vaporous refrigerant may be arranged to leave the compressor 202' through the compressor outlet 207'. Both of the first communicative valve 233' and the second communicative valve 265' may be switched to the air conditioning switching mode. The refrigerant leaving the compressor 202' may pass through the first connecting port 2331' of the first communicative valve 233', the second connecting port 2332', the fifth connecting port 2655' of the second communicative valve 265', the sixth connecting port 2656' of the second communicative valve 265', and enter the second heat exchangers 204' through the second passage ports 231'. The refrigerant may then perform heat exchange with a coolant such as ambient air so as to release heat to ambient air.

The refrigerant may then be guided to exit the second heat exchangers 204' through the first passage ports 230'. The refrigerant leaving the second heat exchangers 204' may then be guided to flow through the first unidirectional valve 236' in Path 1 and enter the condensing unit 32' through the first condensing unit port 321'. The refrigerant may be prevented from entering path 2 by the electronic two-way valve 264' at this time. The refrigerant may further release heat to the cooling water circulating in the condensing unit 32'. The heat released to the condensing unit 32' may be carried away by the cooling water circulating between the cooling tower 31' and the condensing unit 32'. The refrigerant may then leave the condensing unit 32' through the second condensing unit port 322' and be guided to pass through filter 238' and the expansion valve 239' connected in Path 3, the second unidirectional valve 237'in Path 4, and eventually enter the first heat exchanger 203' through the first communicating port 226'. The refrigerant entering the first heat exchanger 203' may then be arranged to perform heat exchange with the heat distribution system so as to absorb heat therefrom. The refrigerant may then be converted back into vaporous or superheated state. The refrigerant may then be guided to leave the first heat exchanger 203' through the second communicating port 227'. The refrigerant may then be guided to flow through the fourth connecting port 2334' and the third connecting port 2333' of the first communicative valve 233' and eventually flow back to the compressor 202' through the compressor inlet 208'. This completes one refrigerant cycle for the comprehensive air conditioning mode. In this mode of operation, refrigerant may be cooled in the second heat exchangers 204 through ambient air and in the condensing unit 32' through cooling water.

On the other hand, the flowing cycle of the cooling water in in the cooling arrangement 3' may be elaborated as follows: the pump 33' may pump cooling water to circulate between the condensing unit 32' and the cooling tower 31'. Cooling water in the condensing unit 32' may be pumped to the first water collection basin 341' and the second water collection basin 351' through the cooling water tower inlet 3115'. The cooling water collected in the first water collection basin 341' and the second water collection basin 351' may be arranged to be distributed on the first fill material unit 342' and the second fill material unit 352' for forming a thin film of water in the first fill material unit 342' and the second fill material unit 352'. At the same time, ambient air is drawn by the fan 314' to flow from the cooling tower air inlet 3111' to the cooling tower air outlet 3112' for allowing heat exchange between the ambient air and the water flowing in the first fill material unit 342' and the second fill material unit 352'. The temperature of the water flowing in the first fill material unit 342' and the second fill material unit 352' will be lowered and collected in the water storage tank 312' provided underneath the first fill material unit 342' and the second fill material unit 352'. Heat from the cooling water flowing through the first fill material unit 342' and the second fill material unit 352' will be released to the ambient air. The water storage tank 312' may communicate with the cooling water tower outlet 3116'. The water in the water storage tank 312' may then be guided to flow back to the condensing unit 32' through the cooling water tower outlet 3116' for another heat exchange cycle.

Note that the refrigerant may be cooled solely by the second heat exchangers 204', and this is the air-cooled air conditioning mode mentioned above. In such scenario, the cooling tower 31' and the pump 33' may be turned off so that the cooling water may stop circulating between the cooling tower 31' and the condensing unit 32'.

The refrigerant flowing path in the air-cooled air conditioning mode may be identical to that of the comprehensive air conditioning mode. The difference between these two modes of operation is that in the former, the cooling tower 31' and the pump 33' may be turned off so that the condensing unit 32' may just act as a storage tank without performing any significant heat exchange function. Refrigerant circulating in the main heat exchange system 2' will only be cooled by ambient air in the second heat exchangers 204.

In the second preferred embodiment, the refrigerant may also be cooled solely by the water circulating between the condensing unit 32' and the cooling tower 31', and this is the water-cooled air conditioning mode. When the central air conditioning and heat pump system is in the water-cooled air conditioning mode, it may be configured to generate cool air to designated indoor spaces. A refrigerant cycle starts from the compressor 202'. Superheated or vaporous refrigerant may be arranged to leave the compressor 202' through the compressor outlet 207'. The first communicative valve 233' may be switched to the air conditioning switching mode. The second communicative valve 265' may be switched to the heat pump switching mode.

The refrigerant leaving the compressor 202' may pass through the first connecting port 2331' of the first communicative valve 233', the second connecting port 2332', the fifth connecting port 2655' of the second communicative valve 265', the eighth connecting port 2658' of the second communicative valve 265', and enter the condensing unit 32' through the first condensing unit port 321' through Path 6. The refrigerant may be arranged to release a predetermined amount of heat to the cooling water circulating in the condensing unit 32'. The heat released to the condensing unit 32' may be carried away by the cooling water circulating between the cooling tower 31' and the condensing unit 32'. The refrigerant leaving the condensing unit 32' through the second condensing unit port 322' may then be guided to pass through filter 238' and the expansion valve 239' connected in Path 3, the second unidirectional valve 237' connected in Path 4, and eventually enter the first heat exchanger 203' through the first communicating port 226'. The refrigerant entering the first heat exchanger 203' may then be arranged to perform heat exchange with the heat distribution system so as to absorb heat therefrom. The refrigerant may then be converted back into vaporous or superheated state. The refrigerant may then be guided to leave the first heat exchanger 203' through the second communicating port 227'. The refrigerant may then be guided to flow through the fourth connecting port 2334' and the third connecting port 2333' of the first communicative valve 233' and eventually flow back to the compressor 202 through the compressor inlet 208'. This completes one refrigerant cycle for the water-cooled air conditioning mode. The so-called "water-cooled air conditioning mode" means that the refrigerant is cooled solely by the cooling water without passing through the second heat exchangers 204'.

The flowing path of the cooling water in the cooling arrangement 3' may be identical to what was disclosed above for the comprehensive air conditioning mode.

Moreover, in the water-cooled air conditioning mode, the second heat exchangers 204' become idle. Residual refrigerant in the second heat exchangers 204' may need to be retrieved and for use in the water-cooled air conditioning mode. Residual refrigerant may be guided to leave the second heat exchangers 204 through the second passage ports 231', and pass through the sixth connecting port 2656', the seventh connecting port 2657', and go back to the compressor 202' through the compressor inlet 208'.

When the central air conditioning and heat pump system is in the heat pump mode, it is configured to generate heat to designated indoor spaces. The corresponding refrigerant cycle also starts from the compressor 202'. Superheated or vaporous refrigerant may be arranged to leave the compressor 202' through the compressor outlet 207'. The first communicative valve 233' and the second communicative valve 265' may be switched to the heat pump switching mode. The refrigerant leaving the compressor 202' may pass through the first connecting port 2331', the fourth connecting port 2334', and enter the first heat exchanger 203' through the second communicating port 227'. The refrigerant may then perform heat exchange with the heat distribution system and release heat thereto. The refrigerant may be converted into liquid state after releasing heat. The refrigerant may then be guided to exit the first heat exchanger 203' through the first communicating port 226'. The refrigerant leaving the first heat exchanger 203' may then be guided to flow through the third unidirectional valve 240' connected in Path 5, and enter the condensing unit 32' through the first condensing unit port 321'. In the heat pump mode, the fan 314' and the pump 33' are turned off. The condensing unit 32' may only act as a storage tank and may not perform significant heat exchange activities.

The refrigerant may then leave the condensing unit 32' through the second condensing unit port 322' and may be guided to flow through the filter 238' and the expansion valve 239' connected in Path 3. The refrigerant may then be guided to pass through the electronic two-way valve 264' in Path 2 and eventually reach the second heat exchangers 204' through the corresponding first passage port 230' for absorbing heat from the ambient air. The refrigerant may then exit the second heat exchangers 204' through the second passage ports 231' and may be guided to flow through the sixth connecting port 2656' of the second communicative valve 265', the seventh connecting port 2657' of the second communicative valve 265', and eventually go back to the compressor 202' through the compressor inlet 208'. This completes one refrigerant cycle in the heat pump mode.

In the second preferred embodiment, the central air conditioning and heat pump system may also operate in a defrosting mode. The defrosting mode may be utilized to remove frost which may be formed on the second heat exchanger 204' when the central air conditioning and heat pump system is operated in the heat pump mode. In the defrosting mode, the corresponding refrigerant cycle also starts from the compressor 202'. Superheated or vaporous refrigerant may be arranged to leave the compressor 202' through the compressor outlet 207'. The first communicative valve 233' and the second communicative valve 265' may be switched to the air conditioning switching mode. The refrigerant leaving the compressor 202' may pass through the first connecting port 2331', the second connecting port 2332' of the first communicative valve 233', the fifth connecting port 2655', the sixth connecting port 2656' of the second communicative port 265', and enter the second heat exchangers 204' through the second passage ports 231' for releasing heat to defrost the second heat exchangers 204'. The refrigerant may exit the second heat exchangers 204' through the first passage ports 230' and may be guided to pass through the first unidirectional valve 236' connected in Path 1. The refrigerant may then be guided to enter the condensing unit 32' through the first condensing unit port 321' and exit the condensing unit through the second condensing unit port 322'. The refrigerant may then be guided to pass through the filter 238' and the expansion valve 239' connected in Path 3. The refrigerant may then be guided to pass through the second unidirectional valve 237' in Path 4 and enter the first heat exchanger 203' through the first communicating port 226'. The refrigerant leaving the first heat exchanger 203' through the second communicating port 227' may then be guided to flow through the fourth connecting port 2334' of the first communicative valve 233', the third connecting port 2333', and eventually go back to the compressor 202' through the compressor inlet 208'. This completes one refrigerant cycle in the defrosting mode.

The present invention, while illustrated and described in terms of the preferred embodiments and several alternatives, is not limited to the particular description contained in this specification. Additional alternative or equivalent components could also be used to practice the present invention.

What is claimed is:

1. A central air conditioning and heat pump system for a heat distribution system, comprising:

a plurality of connecting pipes;

a main heat exchange system, which comprises:

a compressor having a compressor outlet and a compressor inlet;

a first heat exchanger connected to said compressor through at least one of said connecting pipes; and a second heat exchanger connected to said compressor and said first heat exchanger through at least one of said connecting pipes; and a cooling arrangement, which comprises:

a condensing unit;

a cooling tower, which comprises:

a tower casing having a cooling tower air inlet, a cooling tower air outlet, a cooling tower water inlet and a cooling tower water outlet;

at least one cooling unit which comprises a first water collection basin connected to said cooling tower water inlet, and a first fill material unit provided under said first water collection basin;

a water storage tank provided under said first fill material;

a fan provided in said tower casing for drawing ambient air to flow from said cooling tower air inlet to said cooling tower air outlet; and a pump connected between said cooling tower and said condensing unit for pumping water to circulate between said cooling tower and said condensing unit, said condensing unit connecting to said cooling tower, said first heat exchanger and said second heat exchanger through at least one of said connecting pipes, and being arranged to perform heat exchange between said water flowing out of said cooling tower and refrigerant flowing out from said second heat exchanger; and said air conditioning and heat pump system being selectively operated between a comprehensive air conditioning mode and a heat pump mode, wherein in said comprehensive air conditioning mode, a predetermined amount of vaporous refrigerant is arranged to leave said compressor and guided to enter said second heat exchanger for releasing heat thereto, said refrigerant leaving said second heat exchanger being guided to flow into said condensing unit for releasing a predetermined amount of heat to said water circulating between said condensing unit and said cooling tower, said refrigerant leaving said condensing unit being guided to flow through said first heat exchanger for absorbing heat from said heat distribution system, said refrigerant leaving said first heat exchanger being guided to flow back to said compressor to complete an air conditioning cycle, wherein in said heat pump mode, a predetermined amount of vaporous refrigerant is arranged to leave said compressor and guided to flow into said first heat exchanger for releasing heat to said heat distribution system, said refrigerant leaving said first heat exchanger being guided to flow into said condensing unit for being temporarily stored, said refrigerant leaving said condensing unit being guided to flow to said second heat exchanger for absorbing heat from ambient air, said refrigerant leaving said second heat exchanger being guided to flow back to said compressor to complete a heat pump cycle.

2. The central air conditioning and heat pump system, as recited in claim 1, wherein said main heat exchange system further comprises a switching device connecting between said first heat exchanger and said second heat exchanger, said switching device comprising a first communicative valve having first through fourth connecting port, said first communicative valve being arranged to be switched between an air conditioning switching mode and a heat pump switching mode, wherein in said air conditioning switching mode, said first connecting port is connected to said second connecting port, while said third connecting port is connected to said fourth connecting port, wherein in said heat pump switching mode, said first connecting port is connected to said fourth connecting port, while said second connecting port is connected to said third connecting port.

3. The central air conditioning and heat pump system, as recited in claim 2, wherein said first heat exchanger has a first communicating port and a second communicating port, and is configured to act as an evaporator when said central air conditioning and heat pump system is operated in said comprehensive air conditioning mode, and as a condenser when said central air conditioning and heat pump system is operated in said heat pump mode.

4. The central air conditioning and heat pump system, as recited in claim 3, wherein said second heat exchanger has a first passage port and a second passage port, and is configured to act as a condenser when said air conditioning and heat pump system is operated in said comprehensive air conditioning mode, and as an evaporator when said air conditioning and heat pump system is operated in said heat pump mode.

5. The central air conditioning and heat pump system, as recited in claim 4, wherein said first connecting port is connected to said compressor outlet of said compressor, said second connecting port connecting to said second passage port of said second heat exchanger, said third connecting port connecting to said compressor inlet of said compressor, said fourth connecting port connecting to said second communicating port of said first heat exchanger.

6. The central air conditioning and heat pump system, as recited in claim 5, wherein said condensing unit has a first condensing unit port and a second condensing unit port, said first communicating port of said first heat exchanger further connecting to said first condensing unit port of said condensing unit.

7. The central air conditioning and heat pump system, as recited in claim 6, wherein said second heat exchanger is connected to said condensing unit and said first heat exchanger, said condensing unit and said first heat exchanger being connected in a parallel configuration, said main heat exchange system further comprises a first unidirectional valve connected between said first passage port of said second heat exchanger and said first condensing unit port of said condensing unit, said first unidirectional valve being configured to restrict a flow of refrigerant in a direction from said second heat exchanger toward said condensing unit through said first unidirectional valve.

8. The central air conditioning and heat pump system, as recited in claim 7, wherein said second condensing unit port of said condensing unit is connected to said first passage port and said first communicating port so that said refrigerant flowing out from said second condensing unit port is guided to selectively travel toward said first passage port or said first communicating port.

9. The central air conditioning and heat pump system, as recited in claim 8, wherein said main heat exchange system further comprises a second unidirectional valve and a fourth unidirectional valve connected to said second unidirectional valve, said fourth unidirectional valve being connected to said first passage port, while said second unidirectional valve being connected to said first communicating port, said second unidirectional valve and said fourth unidirectional valve being configured such that refrigerant flowing from said second condensing unit port is guided to flow through one of said fourth unidirectional valve toward said first passage port of said second heat exchanger, and said second unidirectional valve toward said first communicating port of said first heat exchanger.

10. The central air conditioning and heat pump system, as recited in claim 9, wherein said main heat exchange system further comprises a third unidirectional valve connected to said first communicating port of said first heat exchanger and said first condensing unit port of said condensing unit and said first unidirectional valve, said third unidirectional valve being configured to allow refrigerant to flow in a direction from said first communicating port toward said first condensing unit port.

11. The central air conditioning and heat pump system, as recited in claim 10, wherein when said central air conditioning and heat pump system is in said comprehensive air conditioning mode, said first communicating device is witched to said air conditioning switching mode so that said refrigerant is guided to sequentially pass through said compressor outlet of said compressor, said first connecting port, said second connecting port, said second passage port of said second heat exchanger, said first passage port of said second heat exchanger, said first unidirectional valve, said first condensing unit port of said condensing unit, said second condensing unit port of said condensing unit, said second unidirectional valve, said first communicating port of said first heat exchanger, said second communicating port of said first heat exchanger, said fourth connecting port, said third connecting port and said compressor inlet of said compressor.

12. The central air conditioning and heat pump system, as recited in claim 10, wherein when said central air conditioning and heat pump system is in said heat pump mode, said first communicative valve is switched to said heat pump mode so that refrigerant is guided to sequentially pass through said compressor outlet of said compressor, said first connecting port, said fourth connecting port, said second communicating port of said first heat exchanger, said first communicating port of said first heat exchanger, said third unidirectional valve, said first condensing unit port of said condensing unit, said second condensing unit port of said condensing unit, said fourth unidirectional valve, said first passage port of said second heat exchanger, said second passage port of said second heat exchanger, said second connecting port, said third connecting port, and said compressor inlet of said compressor.

13. The central air conditioning and heat pump system, as recited in claim 10, further being selectively operated in a defrosting mode, wherein when said central air conditioning and heat pump system is in said defrosting mode, said first communicative valve is switched to said comprehensive air conditioning mode, so that refrigerant is guided to sequentially pass through said compressor outlet of said compressor, said first connecting port, said second connecting port, said second passage port of said second heat exchanger, said first passage port of said second heat exchanger, said first unidirectional valve, said first condensing unit port of said condensing unit, said second condensing unit port of said condensing unit, said second unidirectional valve, said first communicating port of said first heat exchanger, said second communicating port of said first heat exchanger, said fourth connecting port, said third connecting port, and said compressor inlet of said compressor.

14. A central air conditioning and heat pump system for a heat distribution system, comprising:

a plurality of connecting pipes;

a main heat exchange system, which comprises:

a compressor having a compressor outlet and a compressor inlet;

a first heat exchanger connected to said compressor through at least one of said connecting pipes; and a second heat exchanger connected to said compressor and said first heat exchanger through at least one of said connecting pipes; and a cooling arrangement, which comprises:

a condensing unit;

a cooling tower, which comprises:

a tower casing having a cooling tower air inlet, a cooling tower air outlet, a cooling tower water inlet and a cooling tower water outlet;

at least one cooling unit which comprises a first water collection basin connected to said cooling tower water inlet, and a first fill material unit provided under said first water collection basin;

a water storage tank provided under said first fill material;

a fan provided in said tower casing for drawing ambient air to flow from said cooling tower air inlet to said cooling tower air outlet; and a pump connected between said cooling tower and said condensing unit for pumping water to circulate between said cooling tower and said condensing unit, said condensing unit connecting to said cooling tower, said first heat exchanger and said second heat exchanger through at least one of said connecting pipes, and being arranged to perform heat exchange between said water flowing out of said cooling tower and refrigerant flowing out from said second heat exchanger; and said air conditioning and heat pump system being selectively operated between a comprehensive air conditioning mode, a water-cooled air conditioning mode, an air-cooled air conditioning mode, and a heat pump mode, wherein in said comprehensive air conditioning mode, a predetermined amount of vaporous refrigerant is arranged to leave said compressor and guided to enter said second heat exchanger for releasing heat thereto, said refrigerant leaving said second heat exchanger being guided to flow into said condensing unit for releasing a predetermined amount of heat to said water circulating between said condensing unit and said cooling tower, said refrigerant leaving said condensing unit being guided to flow through said first heat exchanger for absorbing heat from said heat distribution system, said refrigerant leaving said first heat exchanger being guided to flow back to said compressor to complete an air conditioning cycle, wherein in said water-cooled air conditioning mode, a predetermined amount of vaporous refrigerant is arranged to leave said compressor and guided to enter said condensing unit for releasing a predetermined amount of heat to said water circulating between said condensing unit and said cooling tower, said refrigerant leaving said condensing unit being guided to flow through said first heat exchanger for absorbing heat from said heat distribution system, said refrigerant leaving said first heat exchanger being guided to flow back to said compressor to complete an air conditioning cycle, wherein in said air-cooled air conditioning mode, a predetermined amount of vaporous refrigerant is arranged to leave said compressor and guided to enter said second heat exchanger for releasing heat thereto, said refrigerant leaving said second heat exchanger being guided to flow through said first heat exchanger for absorbing heat from said heat distribution system, said refrigerant leaving said first heat exchanger being guided to flow back to said compressor to complete an air conditioning cycle, wherein in said heat pump mode, a predetermined amount of vaporous refrigerant is arranged to leave said compressor and guided to flow into said first heat exchanger for releasing heat to said heat distribution system, said refrigerant leaving said first heat exchanger being guided to flow into said condensing unit for being temporarily stored, said refrigerant leaving said condensing unit being guided to flow to said second heat exchanger for absorbing heat from ambient air, said refrigerant leaving said second heat exchanger being guided to flow back to said compressor to complete a heat pump cycle.

15. The central air conditioning and heat pump system, as recited in claim 14, wherein said main heat exchange system further comprises a switching device connected to said first heat exchanger, said second heat exchanger, and said condensing unit, said switching device comprising a first communicative valve having first through fourth connecting port, said first communicative valve being arranged to be switched between an air conditioning switching mode and a heat pump switching mode, wherein when said first communicative valve in said air conditioning switching mode, said first connecting port is connected to said second connecting port, while said third connecting port is connected to said fourth connecting port, wherein when said first communicative valve is in said heat pump switching mode, said first connecting port is connected to said fourth connecting port, while said second connecting port is connected to said third connecting port.

16. The central air conditioning and heat pump system, as recited in claim 15, wherein said switching device further comprises a second communicative valve having fifth through eighth connecting port, said second communicative valve being arranged to be switched between an air conditioning switching mode and a heat pump switching mode, wherein when said second communicative valve in said air conditioning switching mode, said fifth connecting port is connected to said sixth connecting port, while said seventh connecting port is connected to said eighth connecting port, wherein when said second communicative valve is in said heat pump switching mode, said fifth connecting port is connected to said eighth connecting port, while said sixth connecting port is connected to said seventh connecting port.

17. The central air conditioning and heat pump system, as recited in claim 16, wherein said first heat exchanger has a first communicating port and a second communicating port, and is configured to act as an evaporator when said central air conditioning and heat pump system is operated in said comprehensive air conditioning mode, said water-cooled air conditioning mode and said air-cooled air conditioning mode, and as a condenser when said central air conditioning and heat pump system is operated in said heat pump mode.

18. The central air conditioning and heat pump system, as recited in claim 17, wherein said second heat exchanger has a first passage port and a second passage port, and is configured to act as a condenser when said air conditioning and heat pump system is operated in said comprehensive air conditioning mode and said air-cooled air conditioning mode, and as an evaporator when said air conditioning and heat pump system is operated in said heat pump mode.

19. The central air conditioning and heat pump system, as recited in claim 18, wherein said first connecting port is connected to said compressor outlet of said compressor, second connecting port being connected to said fifth connecting port, said third connecting port being connected to said seventh connecting port, said fourth connecting port being connected to said second communicative port of said first heat exchanger.

20. The central air conditioning and heat pump system, as recited in claim 19, wherein said sixth connecting port is connected to said second passage port of said second heat exchanger, said eighth connecting port being connected to said first communicating port of said first heat exchanger and said first passage port of said second heat exchanger.

21. The central air conditioning and heat pump system, as recited in claim 20, wherein said condensing unit has a first condensing unit port and a second condensing unit port, said main heat exchange system further comprising a fifth unidirectional valve connected between said eighth connecting port of said second communicative valve and said first heat exchanger and said first condensing unit port of said condensing unit, said fifth unidirectional valve being configured to allow refrigerant to flow in a direction from said eighth connecting port toward said first condensing unit port through said fifth unidirectional valve.

22. The central air conditioning and heat pump system, as recited in claim 21, wherein said main heat exchange system further comprises a first unidirectional valve connected between said first passage port of said second heat exchanger and said first condensing unit port of said condensing unit, said first unidirectional valve being configured to flow of said refrigerant in a direction from said first passage port toward said first condensing unit port through said first unidirectional valve.

23. The central air conditioning and heat pump system, as recited in claim 22, wherein said main heat exchange system further comprises an electronic two-way valve connected between said first passage port of said second heat exchangers and said second condensing unit port, said electronic two-way valve being configured to allow said refrigerant to flow in a direction from said second condensing unit port toward said first passage port of said second heat exchanger.

24. The central air conditioning and heat pump system, as recited in claim 23, wherein said main heat exchange system further comprises a third unidirectional valve connected to said eighth connecting port of said second communicative valve, said first heat exchanger and said first condensing unit port of said condensing unit, said third unidirectional valve being configured to allow refrigerant to flow in a direction from said first communicating port to said first condensing unit port through said first unidirectional valve.

25. The central air conditioning and heat pump system, as recited in claim 24, wherein said main heat exchange system further comprises a second unidirectional valve connected between said electronic two-way valve and said first communicating port of said first heat exchanger, said second unidirectional valve being configured to allow refrigerant to flow in a direction from said second condensing unit port of said condensing unit toward said first communicating port of said first heat exchanger.

26. The central air conditioning and heat pump system, as recited in claim 25, wherein when said central air conditioning and heat pump system is in said comprehensive air conditioning mode, each of said first communicative valve and said second communicative valve is switched to said air conditioning mode so that refrigerant is guided to sequentially pass through said compressor outlet of said compressor, said first connecting port, said second connecting port, said fifth connecting port, said sixth connecting port, said second passage port of said second heat exchanger, said first passage port of said second heat exchanger, said first unidirectional valve, said first condensing unit port of said condensing unit, said second condensing unit port of said condensing unit, said second unidirectional valve, said first communicating port of said first heat exchanger, said second communicating port of said first heat exchanger, said fourth connecting port, said third connecting port, and said compressor inlet of said compressor.

27. The central air conditioning and heat pump system, as recited in claim 25, wherein when said central air conditioning and heat pump system is in said water-cooled air conditioning mode, said first communicative valve is switched to said air conditioning switching mode, and said second communicative valve is switched to said heat pump switching mode so that refrigerant is guided to sequentially pass through said compressor outlet of said compressor, said first connecting port, said second connecting port, said fifth connecting port, said eighth connecting port, said first condensing unit port of said condensing unit, said second condensing unit port of said condensing unit, said second unidirectional valve, said first communicating port of said first heat exchanger, said second communicating port of said first heat exchanger, fourth connecting port, said third connecting port, and said compressor inlet of said compressor.

28. The central air conditioning and heat pump system, as recited in claim 25, wherein when said central air conditioning and heat pump system is in said heat pump mode, each of said first communicative valve and said second communicative valve is switched to said heat pump switching mode so that refrigerant is guided to sequentially pass through said compressor outlet of said compressor, said first connecting port, said fourth connecting port, said second communicating port of said first heat exchanger, said first communicating port of said first heat exchanger, said third unidirectional valve, said first condensing unit port of said condensing unit, said second condensing unit port of said condensing unit, said electronic two-way valve, said first passage port of said second heat exchangers, said second passage port of said second heat exchangers, said sixth connecting port, said seventh connecting port, and said compressor inlet of said compressor.

29. The central air conditioning and heat pump system, as recited in claim 25, further being operated in a defrosting mode, wherein in said defrosting mode, each of said first communicative valve and said second communicative valve is switched to said air conditioning switching mode so that refrigerant is guided to sequentially pass through said compressor outlet of said compressor, said first connecting port, said second connecting port, said fifth connecting port, said sixth connecting port, said second passage port of said second heat exchanger, said first passage port of said second heat exchanger, said first unidirectional valve, said first condensing unit port of said condensing unit, said second condensing unit port of said condensing unit, said second unidirectional valve, said first communicating port of said first heat exchanger, said second communicating port of said first heat exchanger, said fourth connecting port, said third connecting port, and said compressor inlet of said compressor.

* * * * *